US005363783A

United States Patent [19]

Hori et al.

[11] Patent Number: 5,363,783

[45] Date of Patent: Nov. 15, 1994

[54] SEWING MACHINE HAVING A DIAL FOR SCROLLING DISPLAY SCREEN IMAGE TO SELECT DESIRED PATTERN OF STITCHES

[75] Inventors: Masayuki Hori, Gifu; Yoshiyuki Uyama, Nagoya, both of Japan

[73] Assignee: Brother Kogyo Kabushiki Kaisha, Aichi, Japan

[21] Appl. No.: 61,564

[22] Filed: May 17, 1993

[30] Foreign Application Priority Data

Jun. 3, 1992 [JP] Japan ..... 4-142593

[51] Int. Cl.[5] ..... D05B 19/00; D05B 3/02

[52] U.S. Cl. ..... 112/121.11; 112/445; 112/458

[58] Field of Search ..... 112/121.11, 121.12, 112/445, 456, 458, 457, 453

[56] References Cited

U.S. PATENT DOCUMENTS 4,135,461 1/1979 Sedlatschek ..... 112/458 X
4,393,796 7/1983 Dunn et al. ..... 112/445
5,044,291 9/1991 Kobayashi et al. ..... 112/445
5,097,779 3/1992 Ishikawa et al. ..... 112/445
5,156,107 10/1992 Kyuno et al. ..... 112/458 X

*Primary Examiner*—Peter Nerbun
*Attorney, Agent, or Firm*—Oliff & Berridge

[57] ABSTRACT

A sewing machine capable of sewing selectively in different patterns each created by stitches formed on a work fabric, the machine including a display device having a screen for displaying a library of selectable items which includes icons identifying the different patterns, a display controller including an operator-controlled control dial and operable to specify one of the selectable items displayed on the screen according to a rotary movement of the dial, and a selector including an operator-controlled selecting member and operable to select one selectable item when the selecting member is operated while that one selectable item is specified on the screen. The display controller is operable to scroll the library of selectable items and thereby change a current image on the display screen, when the currently specified selectable item is not included in the current image of the screen.

21 Claims, 22 Drawing Sheets

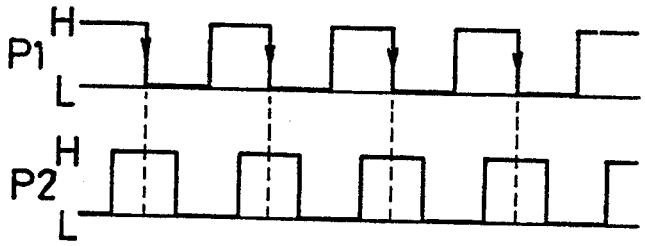
FIG. 4(a)
FIG. 4(b)
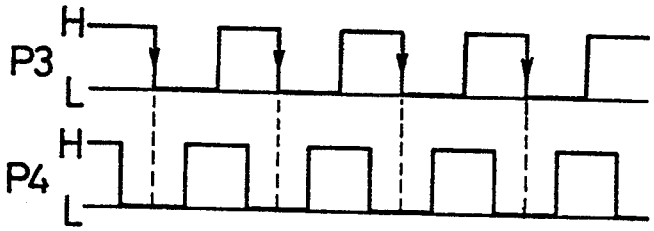
FIG. 5(a)
FIG. 5(b)

SEWING MACHINE HAVING A DIAL FOR SCROLLING DISPLAY SCREEN IMAGE TO SELECT DESIRED PATTERN OF STITCHES

BACKGROUND OF INVENTION

1. Field of the Invention

The present invention relates to a sewing machine having a function of performing a sewing operation in a selected one of different patterns, each pattern being created or defined by stitches formed on a work fabric.

2. Discussion of the Related Art

In such a sewing machine, a suitable pattern selecting device is provided to select a desired one of a multiplicity of stitch patterns such as zigzag stitch patterns available on the machine. The known pattern selecting device is either a direct-selection type device or a ten-key type device. The direct-selection type device uses selector keys which are disposed on a front panel of the machine and which have respective indicia representative of the corresponding stitch patterns. The desired stitch pattern is selected by operating the corresponding one of the selector keys.

The ten-key type device uses ten numeric keys and a display both disposed on a front panel of the machine. According to this arrangement, the individual stitch patterns available for sewing on the machine are identified by respective code numbers, and the desired stitch pattern is selected by entering the corresponding code number through the ten numeric keys.

In the direct-selection type device, the selector keys occupy a considerable area on a limited space of the front panel. Accordingly, the number of the selector keys, that is, the number of the stitch patterns available is limited, or the size of the selector keys should be made small as the number of the selector keys increases. In the latter case where the relatively small selector keys are arranged closely to each other, the operator of the machine tends to feel difficulty in distinguishing or perceiving the indicia representing the stitch patterns.

Where the machine is provided with the ten-key type selector device, the operator tends to feel it cumbersome to determine the code number assigned to the desired stitch pattern, before the appropriate code number is entered through the ten keys. Further, the operator may fail to correctly enter the code number assigned to the stitch pattern in which the operator wants to sew the work fabric.

Usually, the stitch patterns indicated above are patterns of stitches formed to sew two or more superposed fabric cloths together. However, some sewing machines are capable of forming stitches so as to create a desired image or visible representation such as ornamental designs, alphabetic letters or any other characters. In this case, too, the desired pattern to be created by the stitches should be specified by some suitable means.

SUMMARY OF THE INVENTION

It is therefore an object of the present invention to provide a sewing machine which is capable of sewing in a desired pattern selectable from a large number of different patterns each created or defined by stitches formed on the work fabric, and which permits easy and error-free selection of the desired pattern.

The above object may be achieved according to the principle of the present invention, which provides a sewing machine having a function of performing a sewing operation in a selected one of different patterns each of which is created by stitches formed on a work fabric, the sewing machine comprising: (a) a display device having a screen for displaying a library of selectable items which includes at least one band of icons identifying the different patterns; (b) a display controller including an operator-controlled rotatable display control dial and operable to specify one of the selectable items displayed on the screen according to a rotary movement of the display control dial, the display controller being operable to scroll the library of selectable items and thereby change a current image on the screen, when one of the selectable items which is currently specified by the display control controller is not included in the current image on the screen; and (c) a selector including an operator-controlled selecting member and operable to select the above-indicated one of the selectable items as a selected item when the operator-controlled selecting member is operated while the one selectable item is specified on the screen by the display controller.

In the sewing machine constructed according to the present invention as described above, the display device is adapted to display on its screen a portion of a library of selectable items that are selected prior to a sewing operation. The library of selectable items includes one or more bands of icons identifying or representing respective different patterns in which the work fabric is sewn or which are created by stitches formed on the fabric. For instance, the selected pattern is a zigzag stitch pattern in which two or more superposed work fabrics are sewn together, or a pattern consisting of an ornamental design or one or more characters each defined by the stitches formed on the work fabric.

According to the arrangement of the present invention, a desired one of the selectable items is first specified by rotating the display control dial of the display controller while that desired one selectable item is displayed on the screen. If the desired selectable item is not displayed on the screen, the current screen image is changed by scrolling the library of selectable items so that the new screen image contains the desired selectable item. The selectable item specified on the screen by an appropriate rotary movement of the display control dial is finally selected as a selected item by operating the operator-controlled selecting member of the selector. Since the desired selectable item such as a desired stitch pattern is first specified on the screen on which the other selectable items are displayed, the desired selectable item can be readily selected without an error, and without conventionally required cumbersome determination of the code number assigned to that desired item. Further, since the display controller is adapted to scroll the library of selectable items to sequentially change the current image on the screen, as needed, the number of the selectable items available can be increased as needed.

As indicated above, the library of selectable items may include icons identifying various stitch patterns, or icons representative of different patterns of visible representations such as characters (e.g., alphabetic letters, numerals and symbols). In the present disclosure, any forms of visible representations available for display for selection of selectable items on the display screen are referred to as icons, which should be distinguished from the corresponding patterns that are created by stitches actually formed on the work fabric.

The display controller may be adapted to scroll the library of selectable items when the display control dial is rotated to specify a next one of the selectable items which is next to the last selectable item displayed at one of the opposite ends of the current image on the screen. In this case, the library is scrolled to display the specified next selectable item and the following selectable items on the screen such that the next selectable item is located at the end of the new image on the screen which end corresponds to the other of the opposite ends of the above-indicated current image. This arrangement permits the operator to efficiently search for the desired selectable item (e.g., desired stitch pattern) by rotating the display control dial in the appropriate direction. The display controller automatically scrolls the library if necessary to specify the desired selectable item according to the rotary movement of the display control dial.

Alternatively, the display controller may be adapted to scroll the library such that a new image on the screen which appears on the screen by the scrolling includes the specified next selectable item and the selectable items which precede and follow the specified item. This arrangement is advantageous in that one or more selectable items preceding the specified next item is/are also displayed on the screen.

BRIEF DESCRIPTION OF THE DRAWING

The above and optional objects, features and advantages of the present invention will be better understood by reading the following detailed description of presently preferred embodiments of the invention, when considered in connection with the accompanying drawings, in which:

FIGS. 4(*a*) and 4(*b*) are views showing pulse signals generated when the selector dial is rotated clockwise;

FIGS. 5(*a*) and 5(*b*) are views showing pulse signals generated when the selector dial is rotated counterclockwise;

DETAILED DESCRIPTION OF THE PREFERRED EMBODIMENTS

Figure 1:
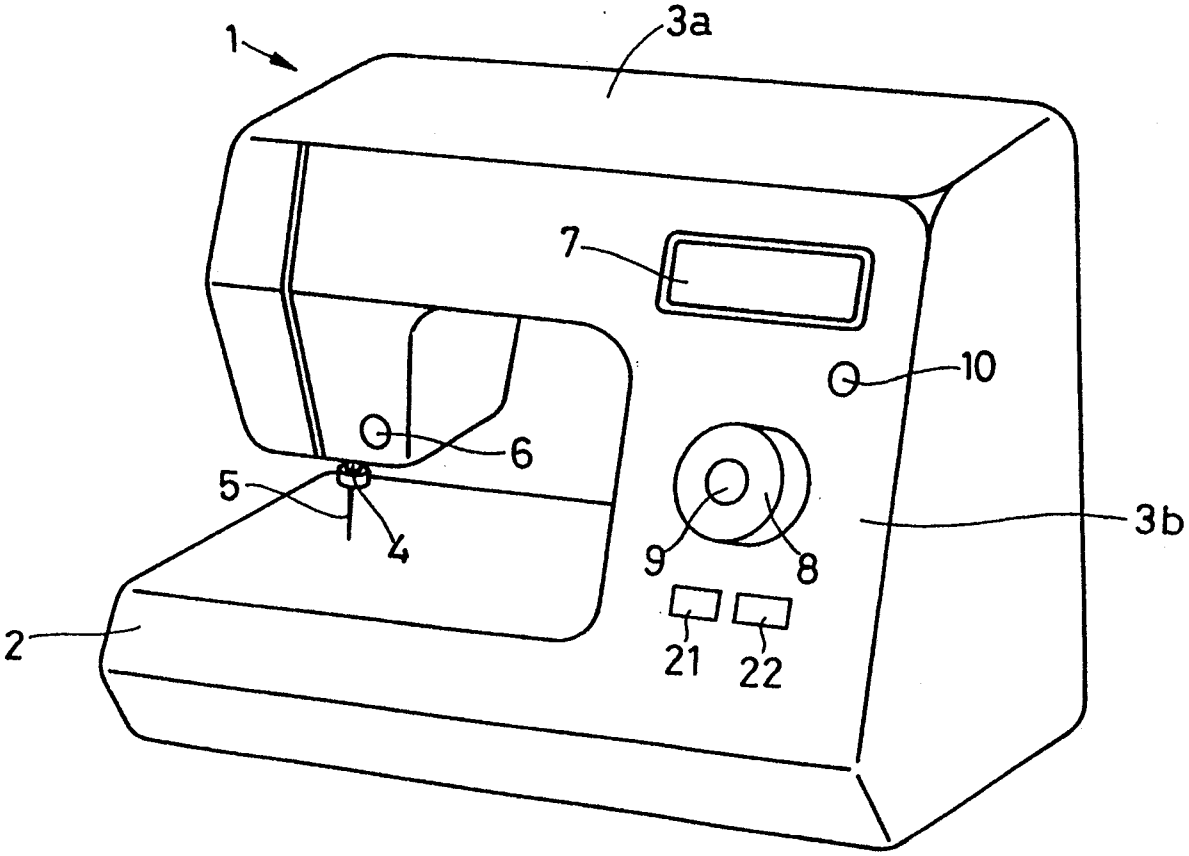
FIG. 1 is a perspective view showing a sewing machine constructed according to one embodiment of this invention.

Referring first to FIG. 1, a sewing machine embodying the present invention is shown generally at 1. The sewing machine has a bed 2, a standard 3*b* extending upright from the bed 2, and an arm 3*a* extending horizontally from the standard 3*b* in parallel with the bed 2. In a left end portion of the arm 3*a*, there is provided a needle bar 4 which is reciprocable in the longitudinal direction, that is, in the vertical direction perpendicular to the plane of the bed 2. As well known in the art, the needle bar 4 is reciprocated by a suitable drive device and carries a sewing needle 5 fixed at its lower end, so that the needle 5 is reciprocated in the longitudinal direction with the needle bar 4.

As also known in the art, the bed 2 incorporates a bobbin case, a shuttle hook rotated in time with the reciprocation of the needle 5, and a mechanism to operate a feed dog for feeding a work fabric also in time with the needle reciprocation. The work fabric is held by a presser foot fixed to the lower end of a presser foot bar, which is also reciprocably supported by the arm 3*a*. The needle bar 4 and the presser foot bar extend parallel to each other and operated in a predetermined timed relation with each other. The needle bar 4, needle 5, shuttle, feed dog, presser foot, etc. cooperate with the drive device to provide a stitch forming mechanism 34 (FIG. 23) for forming stitches on the work fabric. Since the understanding of the stitch forming mechanism 34 is not essential to the understanding of the principle of this invention, no further description of the mechanism 34 is deemed necessary.

On a front panel covering the lower part of the left end portion of the arm 3*a*, there is provided a START/-STOP switch 6 which is turned on to start a sewing operation on the machine 1, and turned off to stop the sewing operation.

A display device in the form of a liquid crystal display (LCD) 7 is attached to an upper part of a front panel 11 (FIG. 2) which covers the front side of the standard 3*b*. This display 7 is provided to display a library of selectable items which are selected prior to a sewing operation. The library includes a multiplicity of icons which identify respective stitch patterns in which stitches are formed to sew the work fabric, or various other patterns which are created by stitches formed on the work fabric, as described below in detail.

Figure 2:
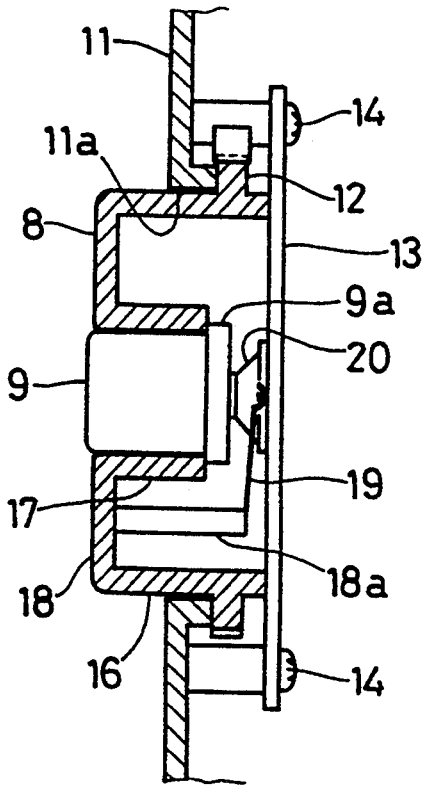
FIG. 2 is a side elevational view in cross section showing a selector dial and an ENTER key provided on a front cover of the sewing machine, and the related components.

Below the liquid crystal display 7, there is disposed an operator-controlled display control dial 8 which is also attached to the front panel 11, as shown in FIG. 2, such that the dial 8 is rotatable about its axis. The dial 8 has a central opening in which is slidably received an operator-controlled selecting member in the form of an ENTER key 9. Below the right end of the display 7, and above and slight to the right of the dial 8, there is disposed an operator-controlled CLEAR key 10, the function of which will be apparent from the following description.

Figure 3:
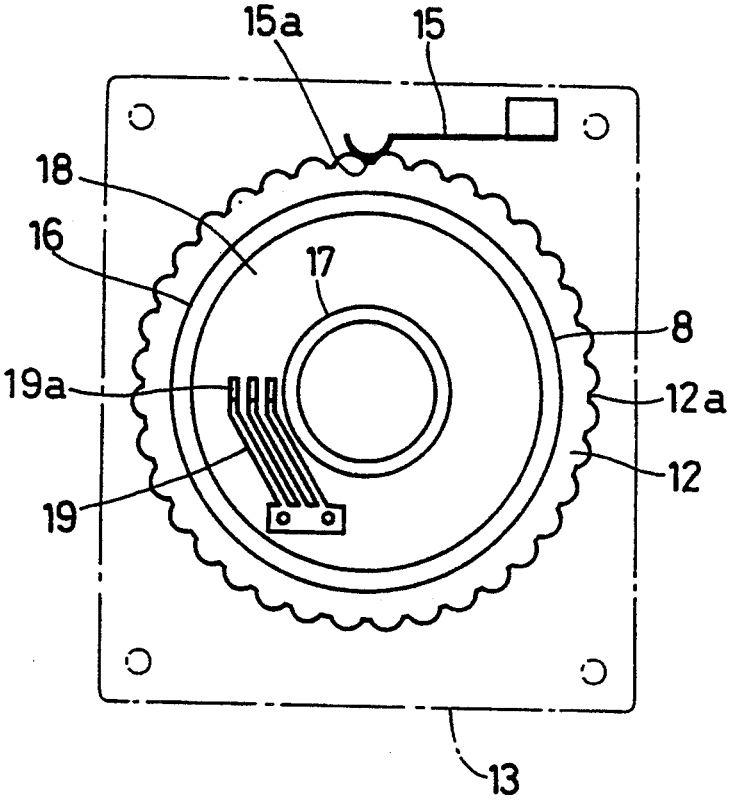
FIG. 3 is a front elevational view showing the dial, key and related components of FIG. 2.

Referring next to FIGS. 2 and 3, the display control dial 8 and the ENTER key 9 will be described in detail. The dial 8 consists of an outer cylindrical wall 16, an inner cylindrical wall 17, and an annular front wall 18 which connects the two cylindrical walls 16, 17 at the axially front ends of the walls 16, 17. The dial 8 is rotatably slidably supported by the front panel 11, such that the outer cylindrical wall 16 engages an aperture 11*a* formed through the front panel 11. The outer cylindrical wall 16 is formed with an outward flange 12 extending radially outwardly from its outer circumferential surface. The outward flange 12, which is located at an axially right end portion of the wall 16, is held in contact with the annular portion of the front panel 11 which defines the aperture 11*a*.

A circuit board 13 having a printed circuit in the form of a conductive pattern is fixed by screws 14 to the inner surface of the front panel 11, such that the circuit board 13 closes the open axial end of the dial 8 remote from the annular wall 18. While the dial 8 is rotatable relative to the front panel 11 and the circuit board 13, the dial 8 is not axially movable relative to these members 11, 13.

As shown in FIG. 3, the outward flange 12 of the display control dial 8 has a multiplicity of recesses 12*a* formed in its circumferential surface. These recesses 12*a* are equally spaced from each other in the circumferential direction of the outward flange 12. Above the flange 12, a sheet spring 15 is fixed to the front panel 11. The sheet spring 15 has a semi-circular or U-shaped free end 15*a*, which is held in pressing contact with the outer circumferential surface of the flange 12, under the biasing force of the spring 15. The flange 12 having the recesses 12*a* and the sheet spring 15 having the U-shaped free end 15*a* cooperate to function as a ratchet device for holding the dial 8 selectively in a multiplicity of angular positions, with the free end 15*a* engaging one of the recesses 12*a* under the biasing force of the spring 15. This biasing force is selected to permit the operator of the machine 1 to rotate the dial 8 relatively easily with a suitable rotating force, but is sufficient to prevent rotation of the dial 8 when the rotating force is removed from the dial.

The annular wall 18 of the dial 8 has a support 18*a* fixed to its inner Surface. The support 18*a* carries three movable contacts 19 fixed to a free end. The movable contacts 19 are made of a spring material and have respective contacting free ends 19*a* for electrical contact with the conductive pattern of the printed circuit on the circuit board 13. The first and second movable contacts 19 correspond to respective first and second terminals of the conductive pattern on the circuit board 13, while the third movable contact 19 corresponds to a common terminal of the conductive pattern. When the dial 8 is rotated in the clockwise direction, pulse signals P1 and P2 are generated from the first and second output terminals, as indicated in FIGS. 4(*a*) and 4(*b*). When the dial 8 is rotated in the counterclockwise direction, pulse signals P3 and P4 are generated from the first and second output terminals, as indicated in FIGS. 5(*a*) and 5(*b*).

The ENTER key 9 is axially slidably received in the central opening defined by the inner cylindrical wall 17 of the dial 8. The key 9 is biased at its inner end by an elastic member of a rubber switch 20, which is disposed in a central portion of the circuit board 13. The rubber switch 20 has a movable contact made of an electrically conductive rubber material. The key 9 is normally held, under the biasing action of the rubber switch 20, in its non-operated position shown in FIG. 2 which is determined by abutting contact between a flange 9*a* formed at the inner end of the key 9, and the inner or rear end of the inner cylindrical wall 17 of the dial 8.

When the ENTER key 9 is depressed against the biasing force of the rubber switch 20, the rubber switch 20 is turned on. When a depressing force acting on the key 9 is removed, the rubber switch 20 is turned off, with a movement of the key 9 back to the non-operated position under the biasing action of the switch 20.

Below the dial 8 and the key 9, there are disposed an INCREMENT key 21 and a DECREMENT key 22 which are used as an operator-controlled member for changing values which represent or relate to the dimensions of stitches used in standard stitch patters which will be described.

Figure 23:
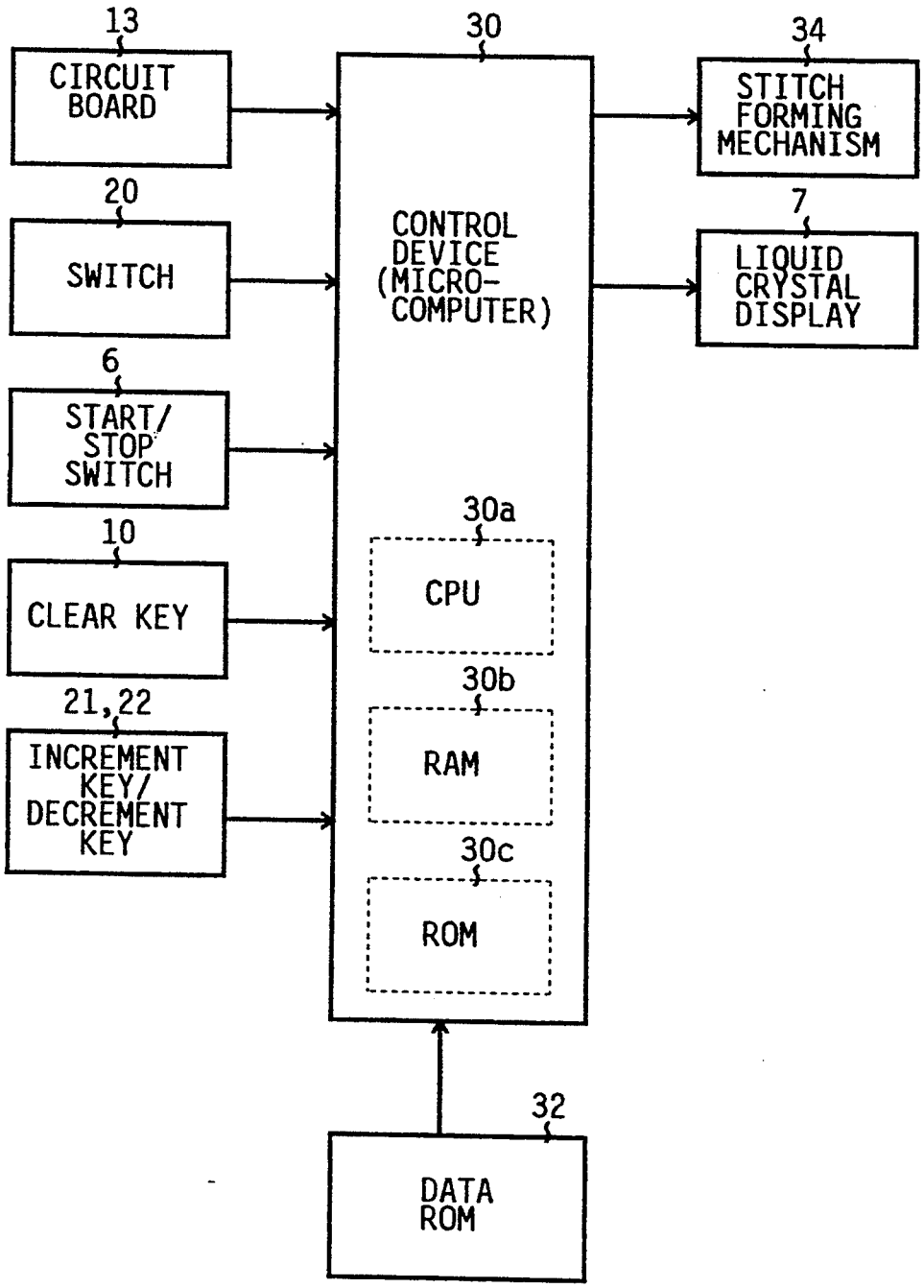
FIG. 23 is a schematic block diagram illustrating a control system for controlling the liquid crystal display and a stitch forming mechanism of the sewing machine.

Referring to the block diagram of FIG. 23, the sewing machine 1 houses a control device 30 whose major portion is constituted by a microcomputer. The control device 30 has a central processing unit (CPU) 30*a*, a random-access memory (RAM) 30*b*, and a read-only memory (ROM) 30*c* which stores various control programs for controlling the operations of the sewing machine 1, in particular, the operations of the stitch forming mechanism 34 and the liquid crystal display 7. The control programs include a display control routine shown in the flow chart of FIG. 24 and a cursor and scroll control sub-routine of FIG. 25. The CPU 30*a* receives the pulse signals P1, P2, P3, P4 from the first and second output terminals of the circuit board 13, and the output signals from the rubber switch 20, START/-STOP switch 6, ENTER key, and INCREMENT and DECREMENT keys 21, 22.

To the control device 30, there is also connected a read-only memory (data ROM) 32 which stores: stitch data representative of stitch positions which define the standard stitch patterns in which stitches are formed in an ordinary sewing operation to sew two or more superposed fabric cloths together; and stitch data representative of stitch positions which define special patterns used in embroidering the work fabric. The special patterns include: Japanese "hiragana" letters; Japanese "katakana" letters; alphabetic letters and numerals; ornamental patterns or designs; and symbols and other characters or visible representations. The data ROM 32 also stores display data representative of a library of icons which identify the standard stitch patterns and the special patterns (such as Japanese and alphabetic letters) and which appear on the screen of the display 7. The data ROM 32 also stores data representative of the dimensions of the stitches used in the standard stitch patterns.

The CPU 30*a* controls the stitch forming mechanism 34 and the display 7, according to the control programs stored in the ROM 30*c* and the stitch data and other data stored in the data ROM 32, while utilizing the temporary data storage function of the RAM 30*b*.

Figure 6:
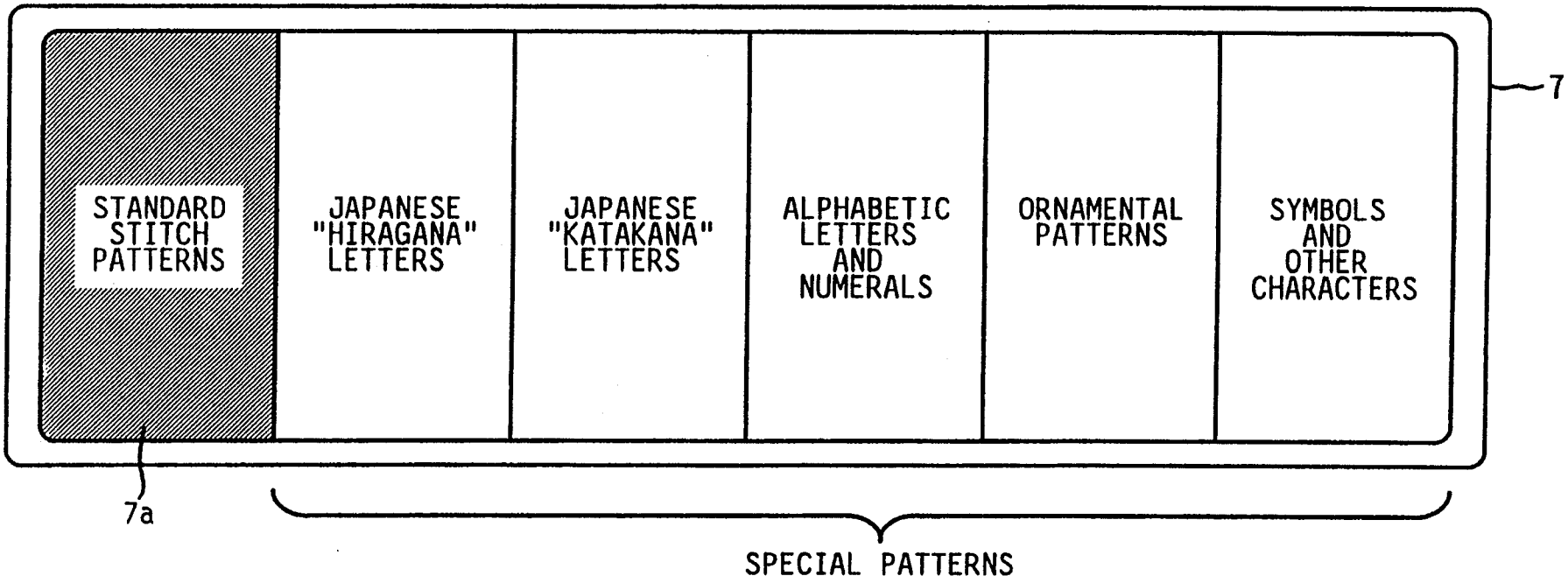
FIG. 6 is a front view indicating a screen image on a liquid crystal display provided on the sewing machine.
Figure 24:
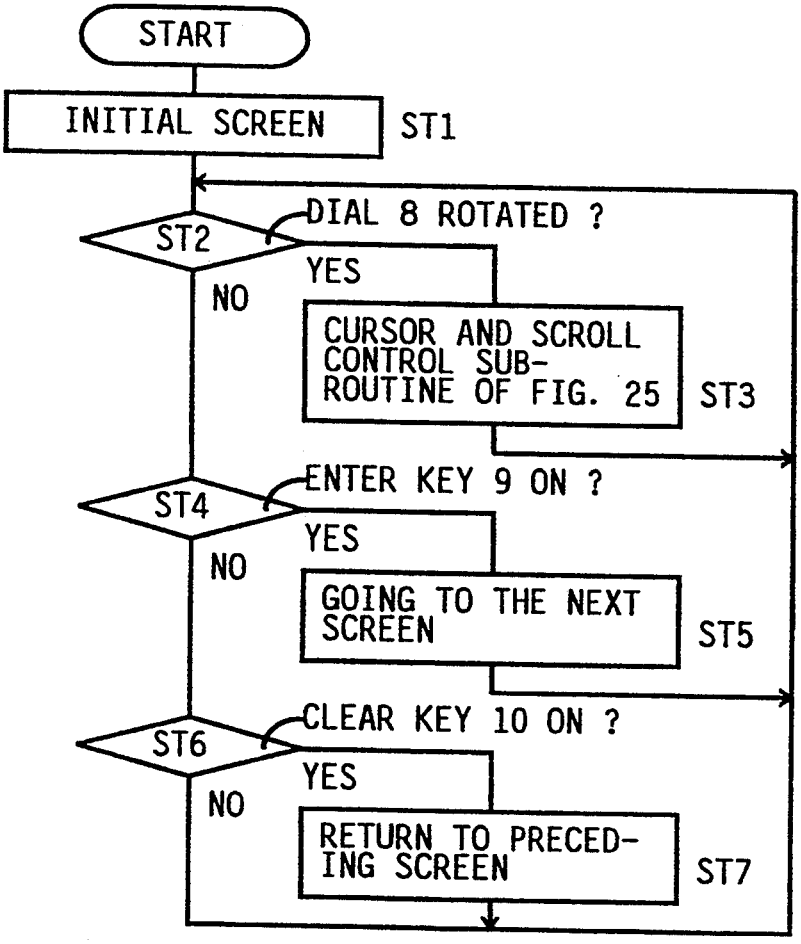
FIG. 24 is a flow chart depicting a control routine for selecting a pattern to be created by stitches formed on a work fabric.

Referring next to FIGS. 6 through 25, there will be described an operation to select a desired standard stitch pattern in which stitches are formed in an ordinary sewing operation, or a desired special pattern to be created by stitches in an embroidering operation. When the sewing machine 1 is turned on with power applied thereto, the display control routine of FIG. 24 is started with step ST1 in which the display 7 provides an initial screen image as shown in FIG. 6. The image consists of a band of six icons (six groups of characters) representative of STANDARD STITCH PATTERNS, JAPANESE HIRAGANA LETTERS, JAPANESE KATAKANA LETTERS, ALPHABETIC LETTERS AND NUMERALS, ORNAMENTAL PATTERNS, and SYMBOLS AND OTHER CHARACTERS, which appear in respective six columns of the screen in the order of description from left to right on the screen.

Initially, only the first column of the screen of the display 7 has a black background, and the icon representative of the STANDARD STITCH PATTERNS appears in white. In FIG. 6, the black background of the first column is indicated by shading. Although the icon (in the form of alphabetic characters) in the first column is indicated in black in FIG. 6, the icon is displayed as white characters in the black background. All the other columns of the display screen have a white background in the initial state. The black background column is shifted as the display control dial 8 is rotated. Thus, the black background column functions as a cursor 7*a*. If the dial 8 is rotated in the clockwise direction, the black background column or the cursor 7*a* is shifted from left to right on the screen. A counterclockwise rotation of the dial 8 causes a leftward shifting of the cursor 7*a*. The cursor 7*a* specifies one of the six different patterns which is identified by the icon appearing in the black background column. In the example of FIG. 6, the cursor 7*a* is located at the first column (black background column), whereby the standard stitch pattern is currently specified on the display screen.

Thus, the mode in which one of the six icons is displayed to specify the corresponding standard stitch pattern is different from the mode in which the other icons are displayed.

Referring back to the flow chart of FIG. 24, step ST1 is followed by step ST2 to determine whether the dial 8 has been rotated or not. If the dial 8 has been rotated clockwise by a predetermined angle corresponding to one of the recesses 12*a*, an affirmative decision (YES) is obtained in step ST2, and the control flow goes to step ST3 to shift the cursor one column to the right. If the dial 8 has been rotated in the counterclockwise direction, the cursor 7*a* is shifted one column to the left in step ST3.

Figure 25:
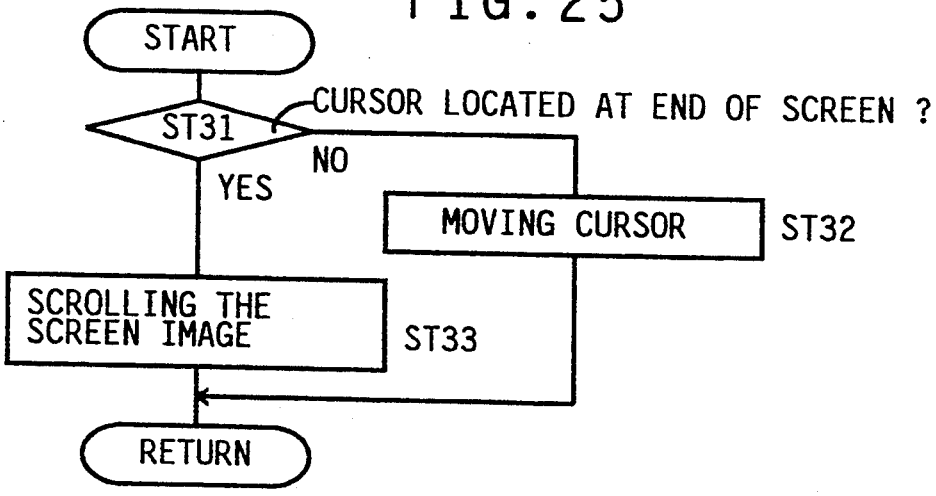
FIG. 25 is a flow chart depicting a control routine for moving the cursor on the display screen or scrolling the screen.

In step ST3, the cursor and scroll control sub-routine of FIG. 25 is executed. If the cursor 7*a* is not located at the leftmost or rightmost column of the display screen, a negative decision (NO) is obtained in step ST31, and the control flow goes to step ST32 in which the cursor 7*a* is shifted or moved one column in the direction corresponding to the rotating direction of the dial 8.

The rotating direction and angle of the display control dial 8 are determined on the basis of the pulse signals received from the first and second output terminals of the conductive pattern on the circuit board 13. More specifically, if the pulse signals P1 and P2 as indicated in FIGS. 4(*a*) and 4(*b*) are received, this means the clockwise rotation of the dial 8. In other words, when the dial 8 is rotated in the clockwise direction, each pulse P1 falls to the low level (L) while the level of the corresponding pulse P2 is high (H). The amount of the clockwise rotation of the dial 8 is determined by the number of the pulses P1 or P2 received.

Similarly, if the pulse signals P3 and P4 as indicated in FIGS. 5(*a*) and 5(*b*) are received, this means the counterclockwise rotation of the dial 8. In other words, when the dial 8 is rotated counterclockwise, each pulse P3 falls to the low level (L) while the level of the corresponding pulse P4 is low (L). The amount of the counterclockwise rotation of the dial 8 is determined by the number of the pulses P3 or P4 received.

Figure 7:
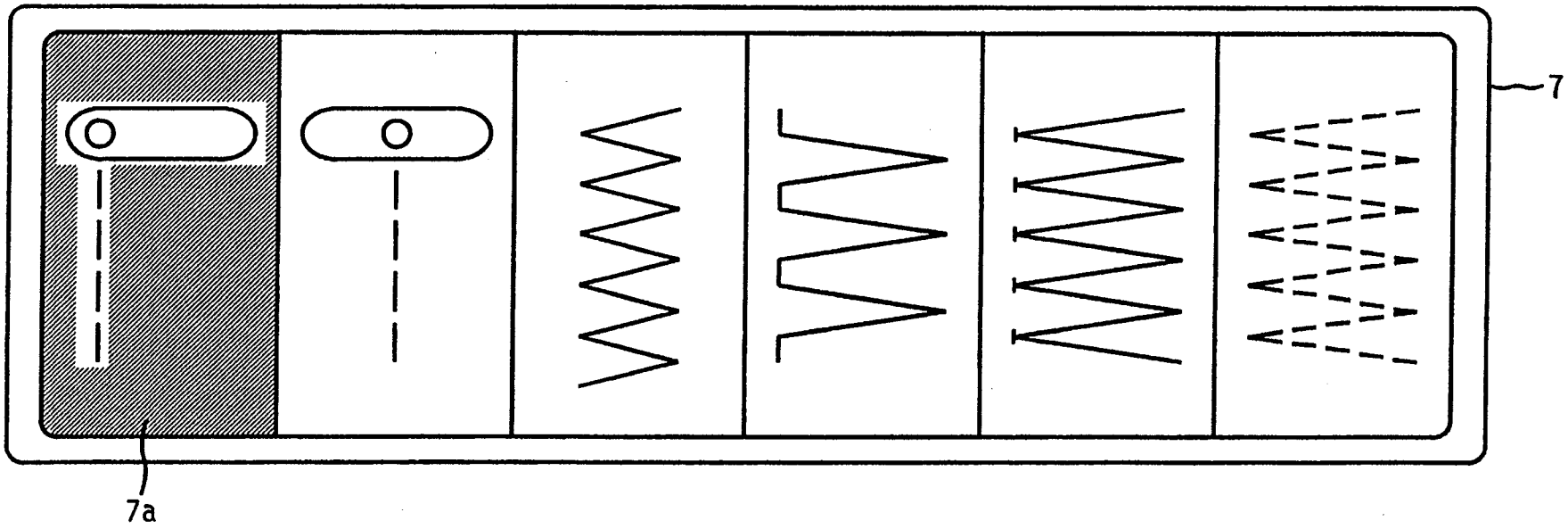
FIG. 7 is a front view indicating another screen image on the display.

If the ENTRY key 9 is depressed when the display 7 is in the state of FIG. 6, an affirmative decision (YES) is obtained in step ST4, and the control flow goes to step ST5 to select the standard stitch pattern currently specified by the cursor 7*a* (located in the black background first column) on the display screen. Further, the screen image is changed or updated from that of FIG. 6 to that of FIG. 7. The new screen image of FIG. 7 provides six icons which identify respective six different standard stitch patterns. The data ROM 32 stores a band of icons which includes other icons than the six icons initially displayed on the screen. Of course, the ROM 32 stores stitch data representative of all the standard stitch patterns identified by the stored band of icons. If the operator desires to select a standard stitch pattern other than those identified by the icons not included in the current screen image, the operator rotates the dial clockwise even after the cursor 7*a* is located at the rightmost or sixth column on the screen. Consequently, step ST2 is followed by step ST3, whereby the sub-routine of FIG. 25 is executed. In this case, an affirmative decision (YES) is obtained in step ST31, and the control flow goes to step ST33 to scroll the band of the standard stitch pattern icons to thereby scroll or update the screen image.

It will be understood that the band of icons initially appearing on the display screen as shown in FIG. 6 is referred to as "a high-order band of icons", while the band of icons appearing on the screen as shown in FIG. 7 upon depression of the ENTER key 9 is referred to as "a low-order band of icons". That is, the low-order band of icons will appear on the display 7 when the ENTER key 9 is operated while one of the icons of the high-order band is specified by the cursor 7*a* on the screen.

Figure 8:
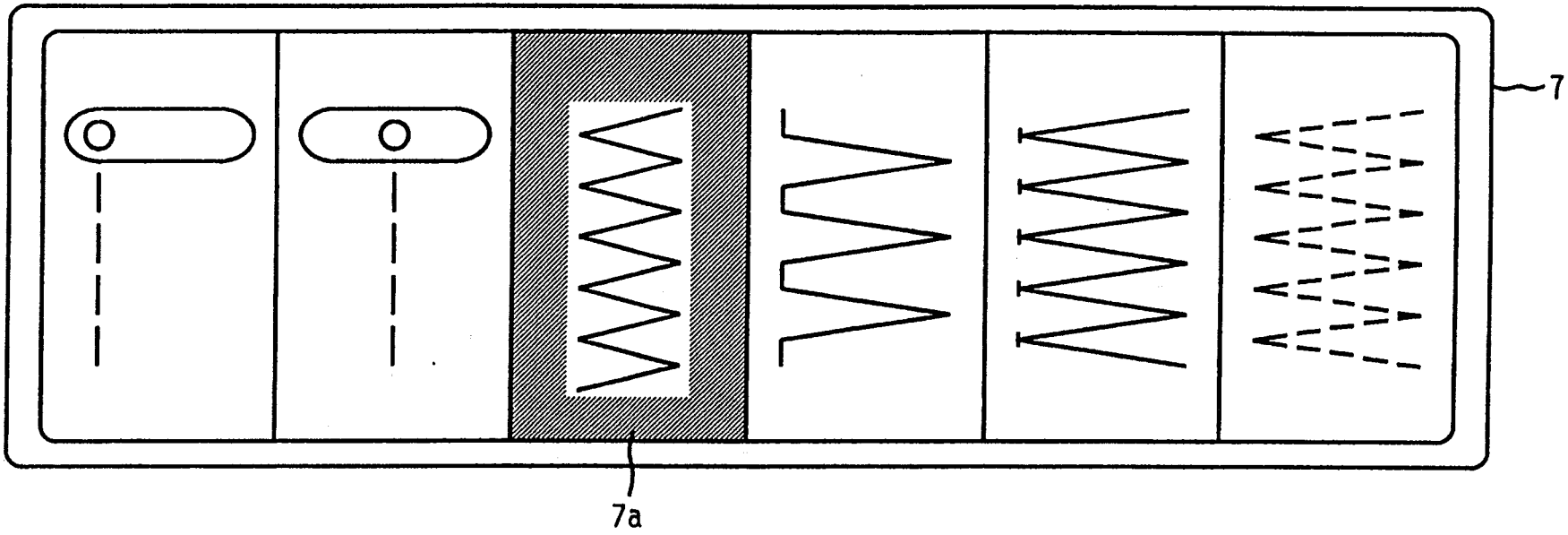
FIG. 8 is a front view indicating the screen image of FIG. 6, with a cursor moved two columns to the right from the position of FIG. 6.

If the operator desires to select the standard stitch pattern identified by the icon displayed in the third column on the screen image on the display 7 as indicated in FIG. 7, the operator rotates the dial 8 until the cursor *7a* moves to the third column, as indicated in FIG. 8. That is, the cursor *7a* is moved two columns to the right by implementation of step ST33 of FIG. 25. In this condition wherein the icon in the third column is specified by the cursor *7a*, the ENTER key 9 is depressed, whereby step ST4 of FIG. 24 is followed by step ST5 to select the corresponding standard stitch pattern whose icon is specified by the cursor *7a* (located at the third column), and to update the screen image as shown in FIG. 9.

Figure 9:
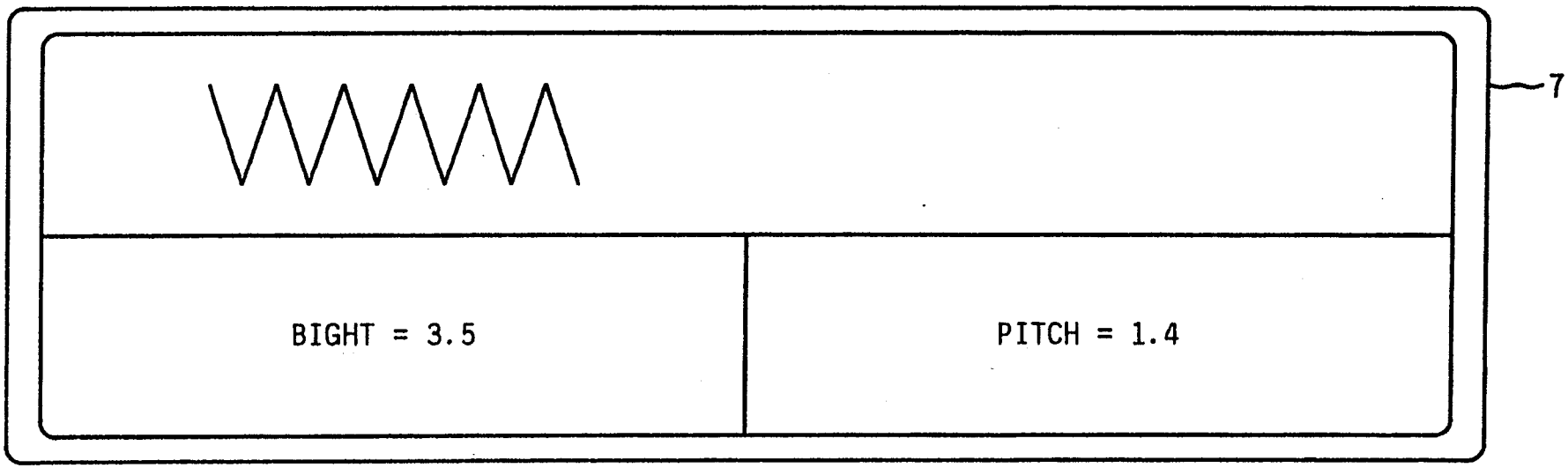
FIG. 9 is a front view indicating a further screen image on the display.
Figure 10:
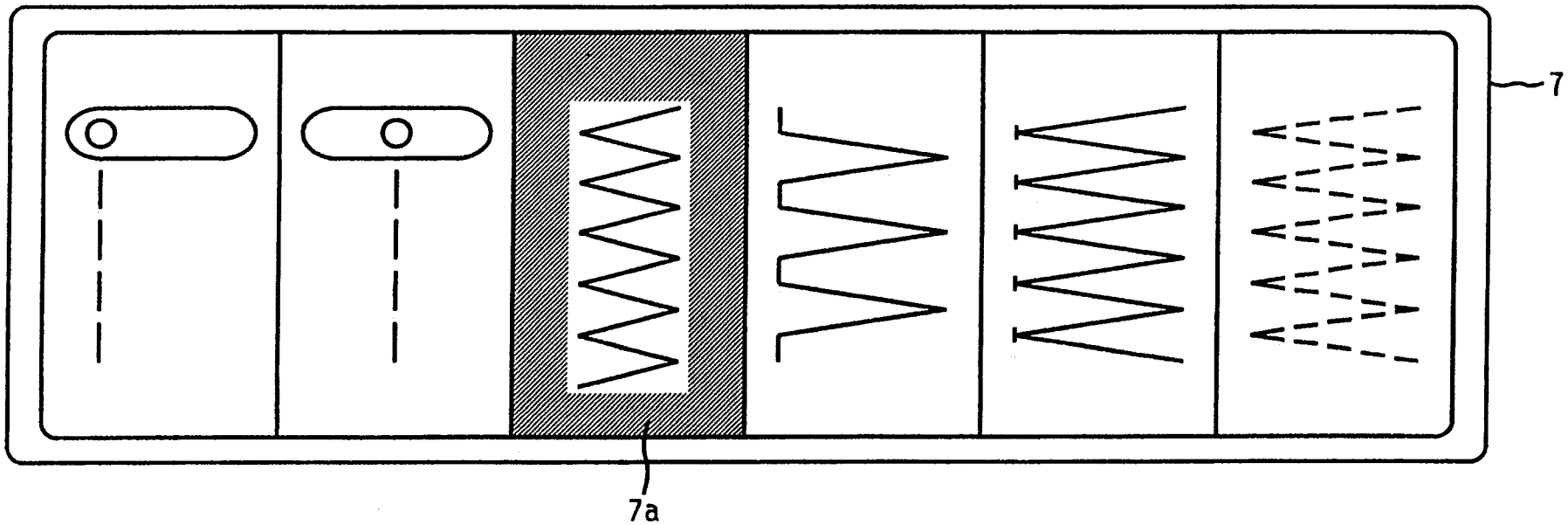
FIG. 10 is a front view indicating the same screen image as indicated in FIG. 8.
Figure 11:
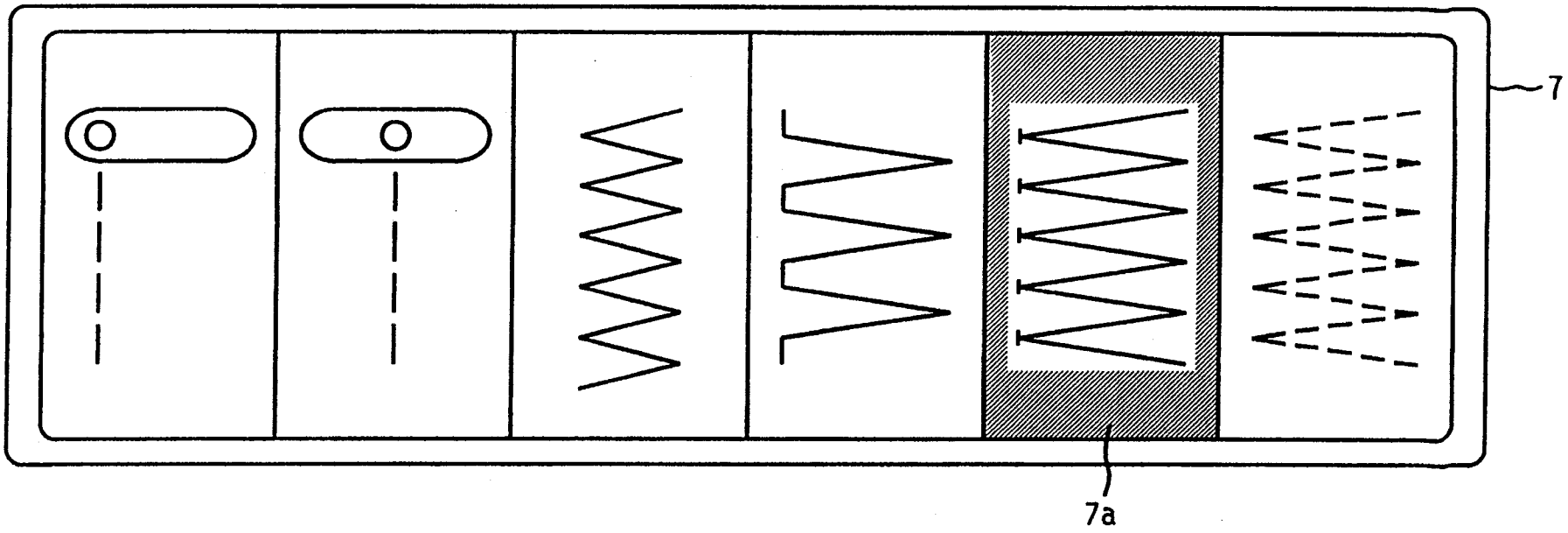
FIG. 11 is a front view indicating the screen image of FIG. 10, with the cursor moved two columns to the right from the position of FIG. 10.

If the operator wishes to cancel the standard stitch pattern once selected, the operator depresses the CLEAR key 10, whereby an affirmative decision (YES is obtained in step ST6, and step ST7 is implemented to return the screen image from the current image of FIG. 9 to the preceding image as indicated in FIG. 10 (same image as shown in FIG. 8). If the operator wishes to select the standard stitch pattern corresponding to the fifth column on the display screen, the operator rotates the dial 8 clockwise by an amount corresponding to the two columns (two recesses 12*a*), to move the cursor *7a* to the fifth column, as shown in FIG. 11. In this condition wherein the icon in the fifth column is specified by the cursor *7a*, the ENTER key 9 is operated to select the corresponding standard stitch pattern. Namely, step ST5 is implemented and the screen image is updated as shown in FIG. 12.

Figure 12:
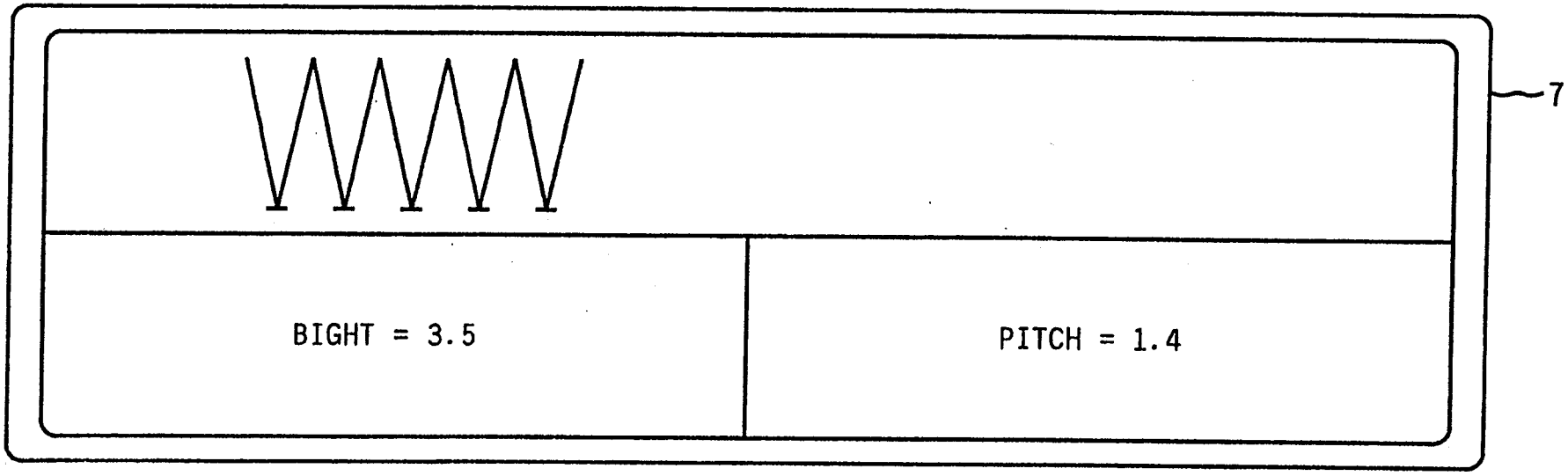
FIG. 12 is a front view indicating a still further screen image on the display.

The image shown in FIG. 12 includes the icon identifying the selected stitch pattern displayed in the upper region of the screen, and two successions of characters in the lower region of the screen. The two successions of characters represent or relate to the dimensions of the stitches of the selected standard stitch pattern, more specifically, a "bight" and a "pitch" of the stitches. The "bight" is a side-to-side width which is a distance of oscillation of the sewing needle 4 in the direction perpendicular to the direction in which the work fabric fed by the feed dog. The "pitch" is a distance between adjacent two zigzag stitch points placed on the same side (e.g., lower side of the zigzag stitch as represented by the icon shown in FIG. 12), as measured in the direction of feed of the work fabric.

In the present embodiment, the bight and pitch dimensions of the stitches can be changed as desired, by changing the corresponding values displayed in the lower region of the screen of the display 7, by using the INCREMENT and DECREMENT keys 21, 22. For instance, the values can be incremented and decremented by a predetermined amount of 0.1 each time the corresponding keys 21, 22 are depressed. In the present specific example, the values "3.5" and "1.4" as indicated in FIG. 12 represent the bight of 3.5 mm and the pitch of 1.4 mm, respectively. If the operator wishes to change the pitch to 4.0 mm, the INCREMENT key 21 is depressed the appropriate number of times, and the value for the pitch is changed as indicated in FIG. 13.

Figure 13:
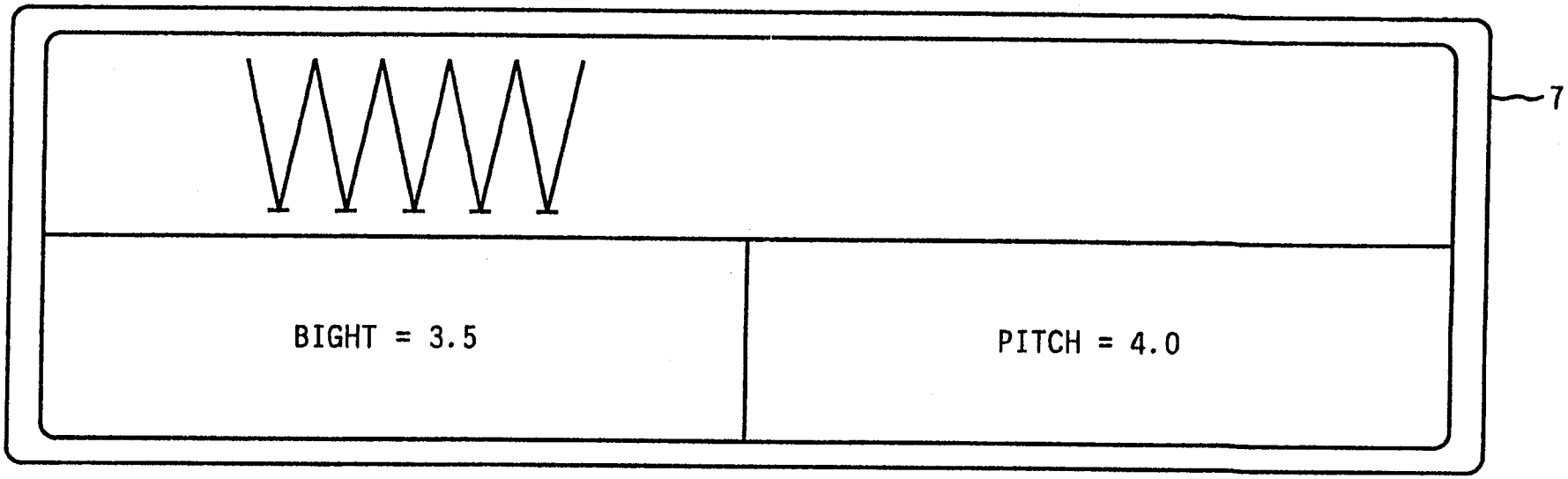
FIG. 13 is a front view indicating the screen image of FIG. 12, with a change in a displayed dimensional value from that of FIG. 12.

To start a sewing operation with the standard stitch pattern of FIG. 13 being selected, the START/STOP switch 6 is depressed. As a result, the stitch forming mechanism 34 is activated and operated according to the corresponding stitch data stored in the data ROM 32. To stop or interrupt the sewing operation, the switch 6 is again depressed. During the sewing operation, the screen image of the display 7 remains in the state indicated in FIG. 13.

If it is desired to perform another sewing or embroidering operation after the above sewing operation, the CLEAR key 10 is depressed. Described more specifically by reference to the flow chart of FIG. 24, an affirmative decision (YES) is obtained in step ST6 if the CLEAR key 10 is depressed when the screen image of the display 7 is in the state of FIG. 13. As a result, step ST7 is implemented to change the screen image to that of FIG. 11. If the CLEAR key 10 is again depressed when the screen image is in the state of FIG. 11, step ST7 is again implemented to change the screen image to the initial screen image of FIG. 6. In this condition, the desired standard stitch pattern or special pattern can be specified by the dial 8 and selected by the ENTER key 9.

Figure 14:
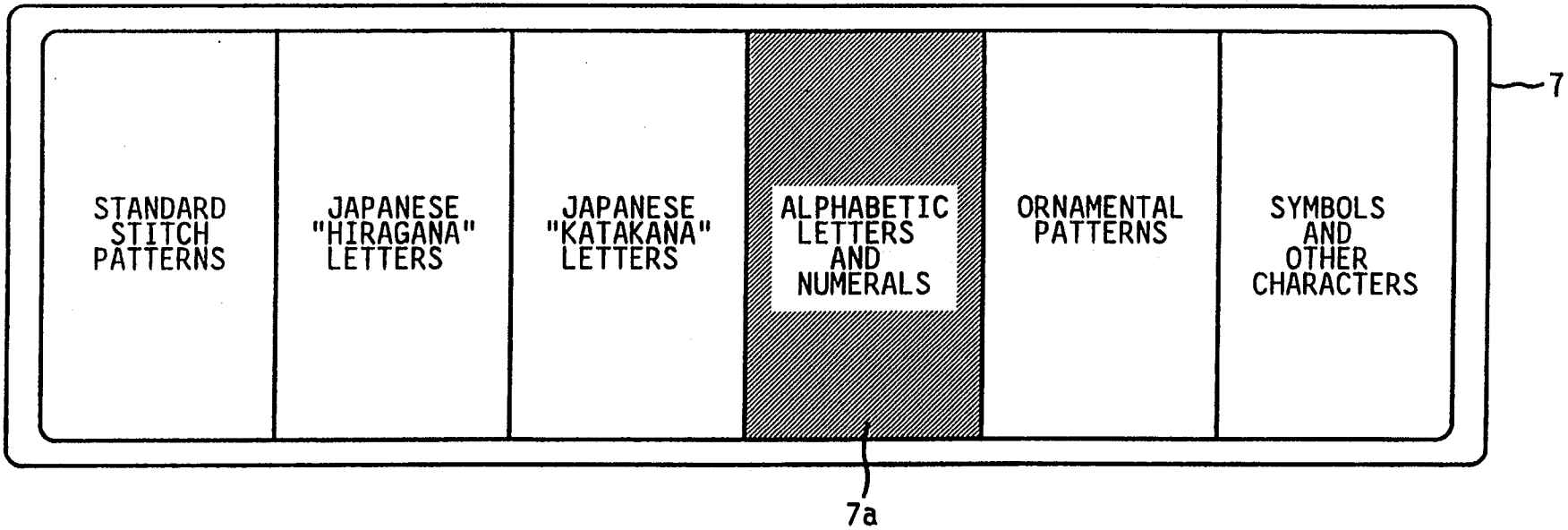
FIG. 14 is a front view indicating the screen image of FIG. 6, with the cursor moved three columns to the right from the position of FIG. 6.
Figure 15:
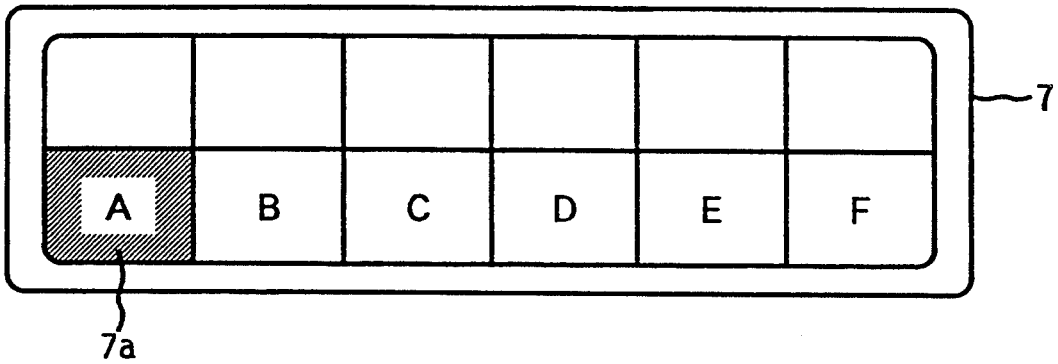
FIG. 15 is a front view indicating another screen image on the display.

If the operator wishes to embroider a combination of alphabetic characters "C" and "K", for instance, the operator first rotates the dial 8 in the clockwise direction until the cursor *7a* reaches the fourth column in which the icon identifying the ALPHABETIC LETTERS AND NUMERALS is displayed. When the ENTER key 9 is depressed while the cursor *7a* is located at the fourth column as indicated in FIG. 14, the display 7 provides a screen image as indicated in FIG. 15. In the initial state of this phase of control of the display 7, the initial portion of a band of icons which identify the alphabetic letters and the ten numerals (digits) is displayed in the lower region of the screen. More particularly, the icons representative of letters "A" through "F" are displayed at the respective six positions in the lower region of the screen, with the cursor *7a* located at the first or leftmost position, as indicated in FIG. 15. Thus, the band of icons identifying the alphabetic letters and numerals is a low-order band of icons with respect to the high-order band of icons which is partially displayed on the screen as indicated in FIGS. 6 and 14.

Figure 16:
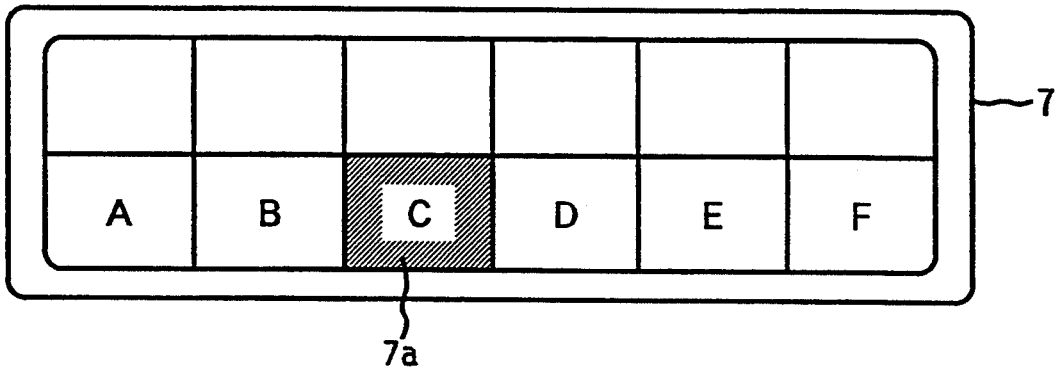
FIG. 16 is a front view indicating the screen image of FIG. 15, with the cursor moved two columns to the right from the position of FIG. 15.

In the state of FIG. 15, the operator rotates the dial 8 until the cursor *7a* reaches the third position of the lower region of the display screen, which corresponds to the letter "C". Then, the letter "C" thus specified by the cursor as indicated in FIG. 16 is selected as a first portion of a special pattern, by depressing the ENTER key 9. As a result, an icon representative of the selected pattern or letter "C" appears at the first position in the upper region of the screen as indicated in FIG. 17.

Figure 18:
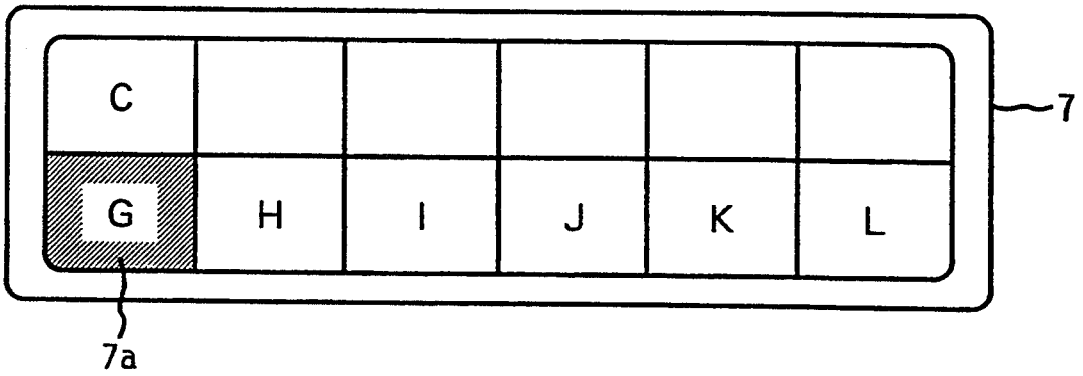

To select the letter "K" whose icon is not contained in the current screen image, the operator rotates the dial 8 clockwise even after the cursor *7a* reaches the rightmost or sixth position corresponding to the letter "F". Consequently, the affirmative decision (YES) is obtained in step ST31, and the control flow goes to step ST33 to scroll the appropriate band of icons to update the screen image as indicated in FIG. 18. The updated screen image displays the icons for the following six letters "G" through "L", with the cursor *7a* located at the first or leftmost position.

Figure 17:
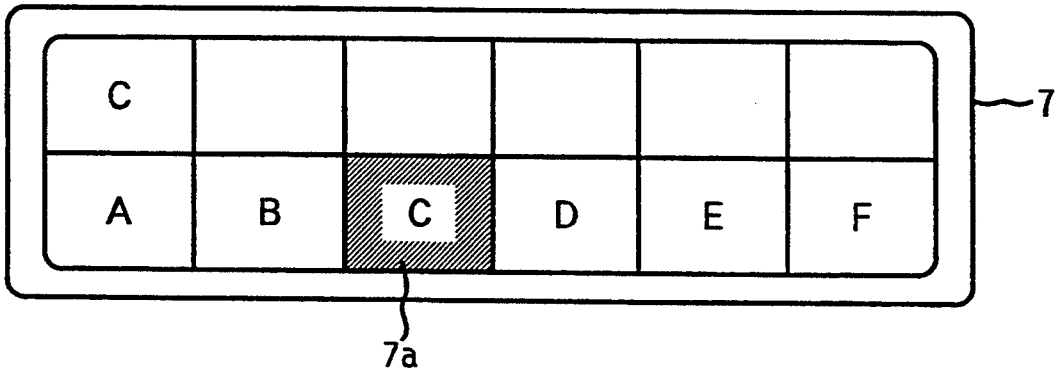
FIGS. 17 through 22 are front view indicating further screen images on the display.

If the dial 8 is rotated in the counterclockwise direction when the display 7 has the screen image as indicated in FIG. 18, the band of icons is scrolled in the reverse direction to update the screen image as indicated in FIG. 17. If the dial 8 is rotated in the clockwise direction even after the cursor *7a* reaches the rightmost position, the band of icon is further scrolled in the forward direction.

Figure 19:
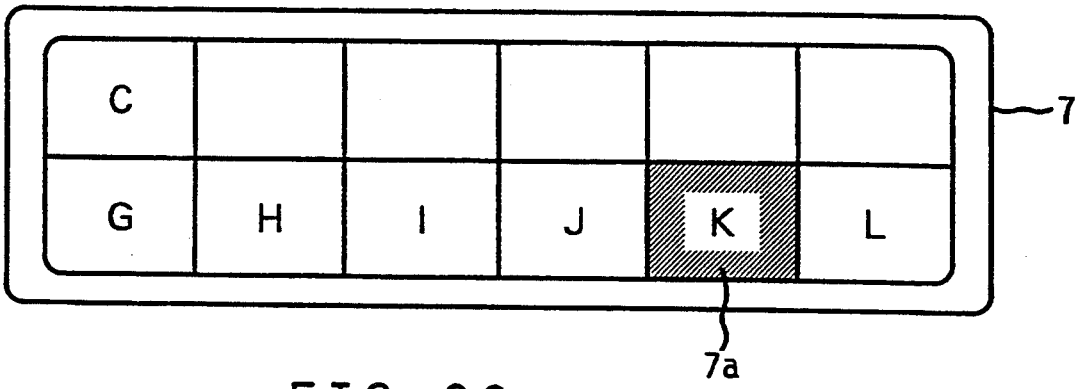
Figure 20:
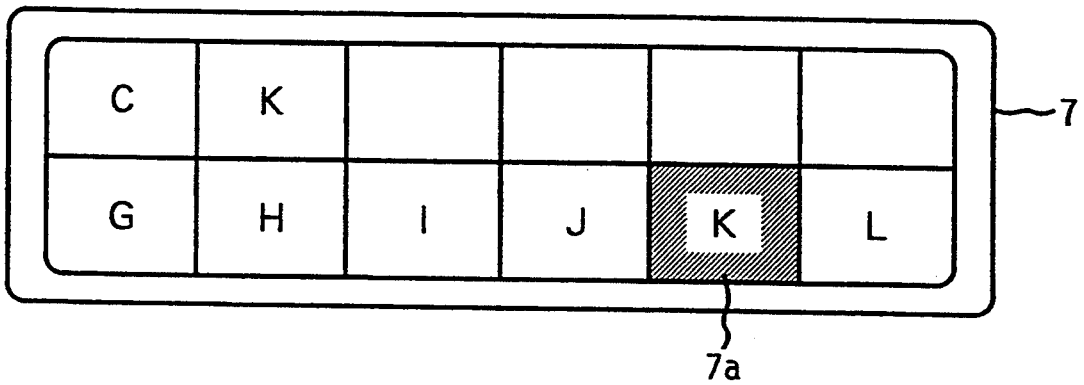
Figure 21:
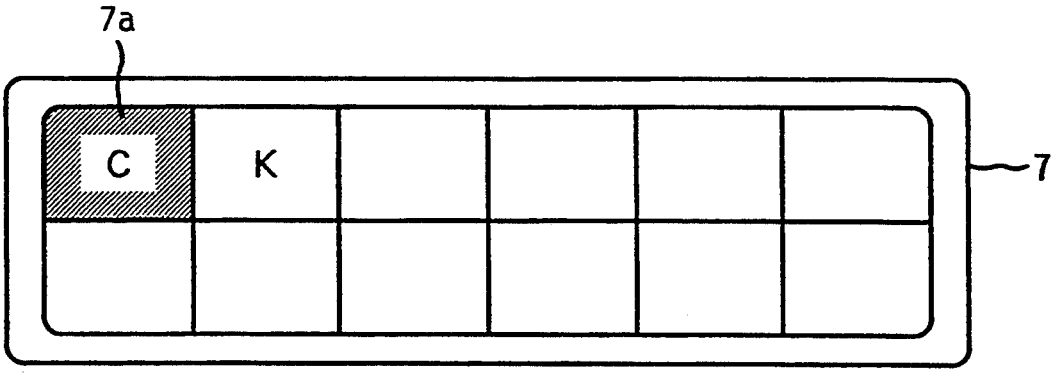
Figure 22:
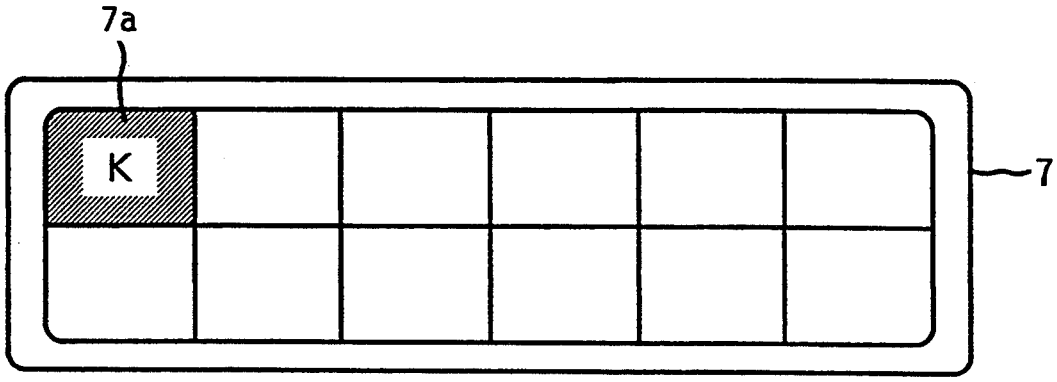

After the image as indicated in FIG. 18 appears on the screen of the display 7, the operator further rotates the dial 8 in the clockwise direction until the cursor *7a* reaches the fifth position corresponding to the letter "K", as indicated in FIG. 19. In this condition, the ENTER key 9 is depressed to select the letter "K" as a second portion of the special pattern (combination of letters "C" and "K"). As a result, the icon for the selected letter "K" is displayed at the second position in the upper region of the screen, as indicated in FIG. 20. Thus, the desired combination of letters "C" and "K" is selected as a special pattern to be created by stitches formed on the work fabric.

To embroider the special pattern "CK", the START/STOP switch 6 is turned on to activate the stitch forming mechanism 34. Immediately after the embroidering operation is started, the background of the first position area in the upper region of the display screen is changed from white to black, and the icon for the letter "C" is displayed in white. This change in the background at the first position means that the stitch forming mechanism 34 is in the process of forming stitches so as to create the letter "C".

Immediately after the formation of the stitches for the next letter "K" is initiated following the formation of the stitches for the letter "C", the icon for the letter "C" at the first position in the upper region of the screen is erased, and replaced by the icon for the letter "K". That is, the icon for the letter "K" is shifted from the second position to the first position, while the black background remains at the first position. This means that the stitches for the letter "K" are in the process of being formed.

When the entire embroidering operation for the combination of letters "C" and "K" is finished, the screen image of the display 7 returns to that of FIG. 20. If the operator desires to select a standard stitch pattern for a sewing operation or a special pattern to be formed by an embroidering operation, the CLEAR key 6 is depressed to return the screen image to the initial image as indicated in FIG. 6.

It will be understood from the above description of the present embodiment that a desired one of selectable items can be easily selected while the selectable items are displayed on the display 7. Described more particularly, a desired standard stitch pattern or a desired special pattern (e.g., combinations of Japanese or alphabetic letters) can be readily selected by rotating the display control dial 8 and by depressing the ENTER key 9, while the icons identifying or representing the stitch patterns or special patterns are displayed on the screen of the display 7. If the icon for the desired pattern is not included in the current screen image, the appropriate band of icons is automatically scrolled in response to the rotation of the dial 8 even after the cursor 7*a* reaches the rightmost or left most position of the screen. This arrangement enables the display 7 to display a library of icons for a large number of different patterns each created by stitches formed on the work fabric. The library of icons may include a desired number of bands of icons which correspond to respective different groups of patterns such as standard stitch patterns for an ordinary sewing operation, and special stitch patterns such as characters and ornamental patterns or representations which are formed by an embroidering operation.

In the present arrangement, the desired pattern is selected by first specifying the corresponding icon displayed on the screen of the display 7, by moving the cursor 7*a* on the screen by rotating the dial 8 while observing the screen image. Thus, the present sewing machine 1 eliminates the conventionally required cumbersome procedure to first determine the code numbers assigned to the individual patterns, before entering the determined code numbers through a ten-key keyboard. Further, the present sewing machine 1 assures easy and reliable selection of the desired pattern, with the aid of the display 7 which is effective to prevent erroneous selection of the desired pattern.

Further, the automatic scrolling of the stored library of icons (selectable items) to thereby scroll or shift the screen image on the display 7 permits easy and fast search for the desired icon or pattern. In the specific example of the above embodiment, the screen image shown in FIG. 17 is changed to that shown in FIG. 18, when the dial 8 is rotated clockwise even after the cursor 7*a* has reached the rightmost column on the screen. Thus, the first screen image covers the first six icons for the letters "A" through "F", and the second screen image provided by the first scrolling covers the next six icons for the letters "G" through "L", such that the icon for the letter "G" immediately following the icon for the letter "F" displayed at the last or sixth position in the first or preceding screen image is located at the first position in the new or second screen image.

Figure 26A:
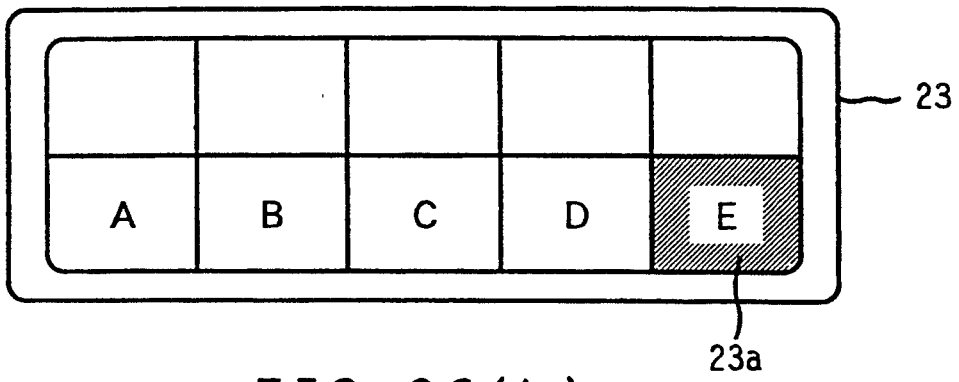
FIGS. 26(*a*) and 26(*b*) are front views indicating a modified form of scrolling the display screen according to a second embodiment of this invention.
Figure 26B:
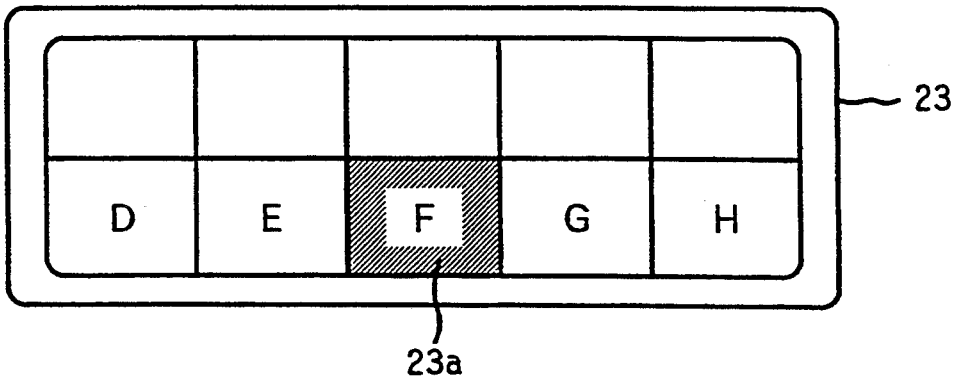
Figure 27:
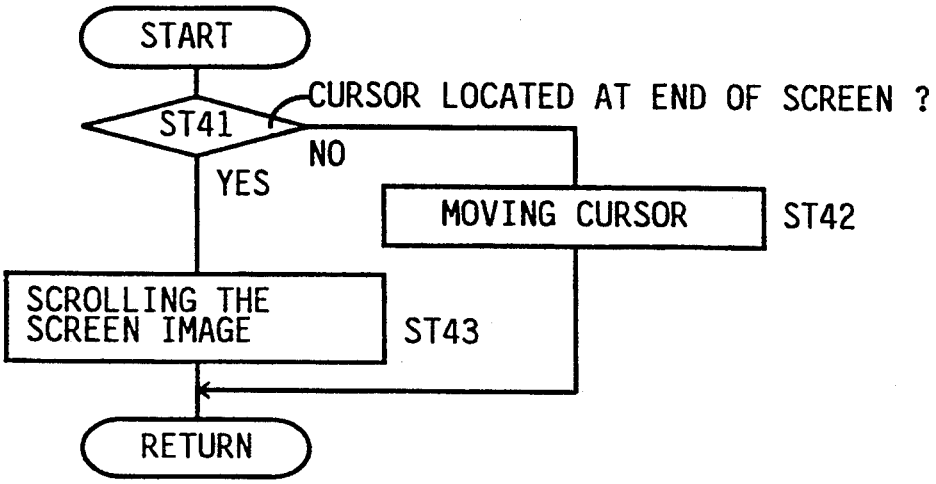
FIG. 27 is a flow chart depicting a control routine corresponding to that of FIG. 25, which is used in the second embodiment.
Figure 28A:
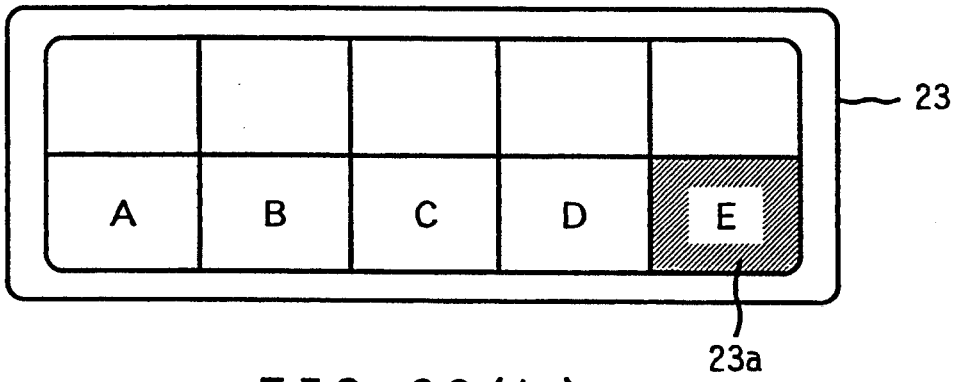
FIGS. 28(*a*) and 28(*b*) are front views indicating another modified form of scrolling the display screen according to a third embodiment of the invention.
Figure 28B:
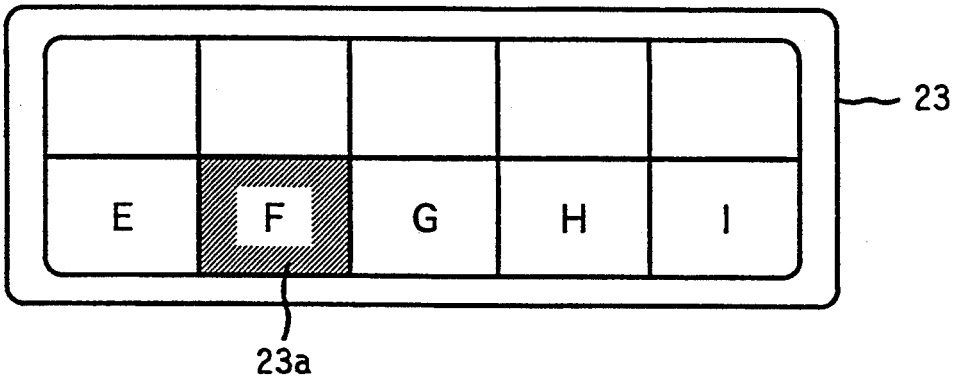
Figure 29:
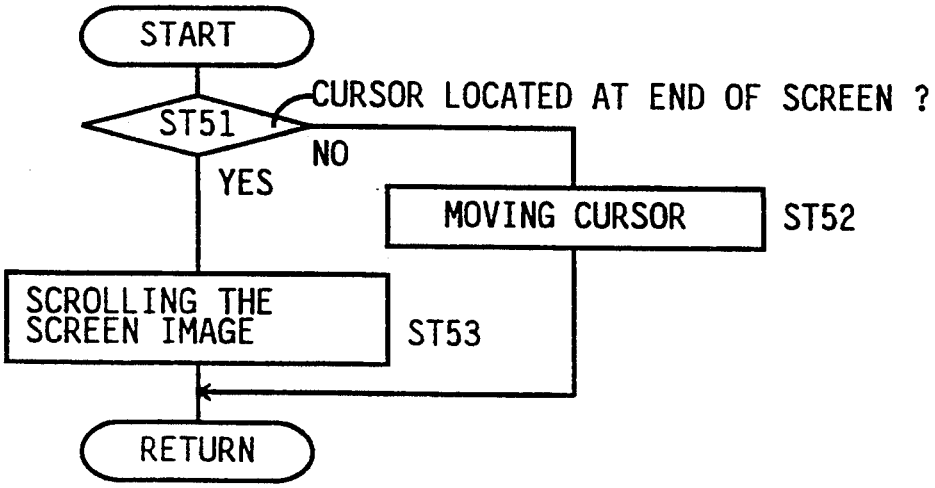
FIG. 29 is a flow chart depicting a control routine used in the third embodiment.
Figure 30A:
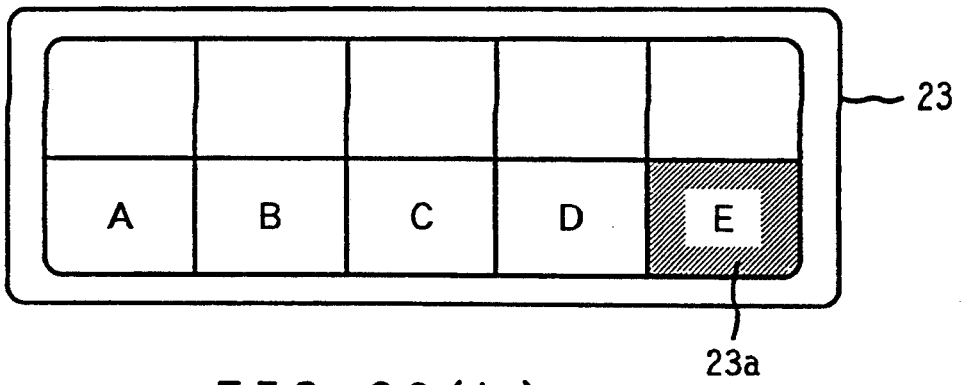
FIGS. 30(*a*) and 30(*b*) are front views indicating a further modified form of scrolling the display screen according to a fourth embodiment of the invention.
Figure 30B:
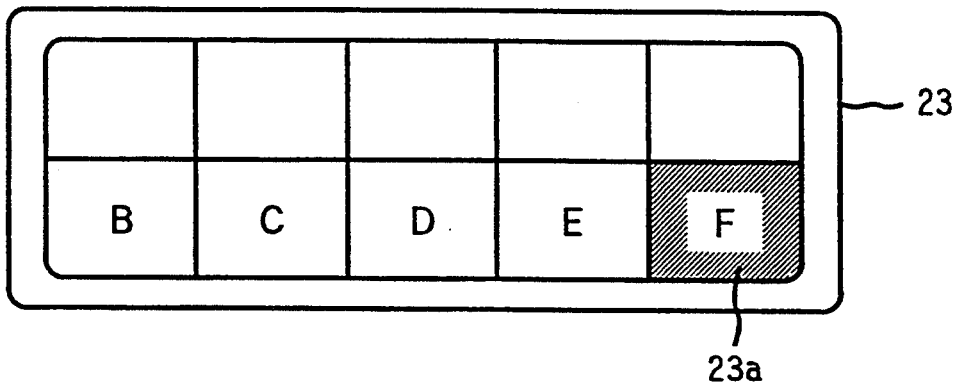
Figure 31:
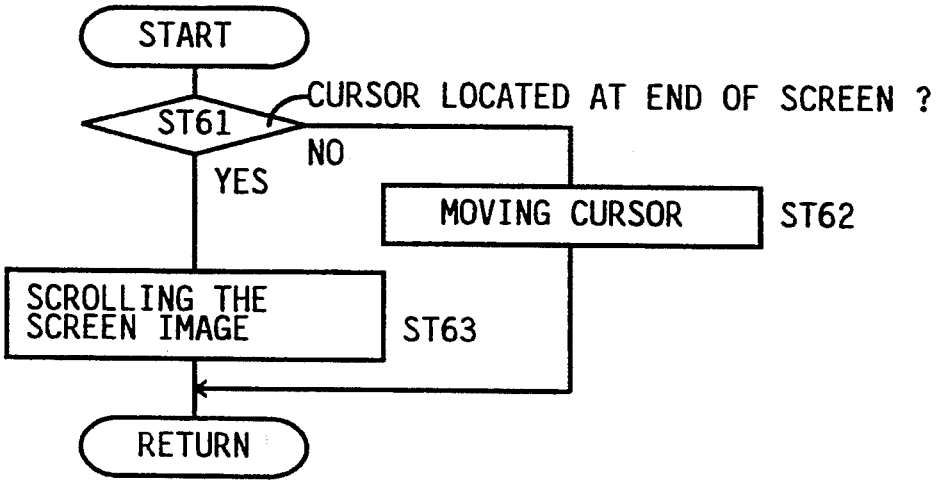
FIG. 31 is a flow chart depicting a control routine used in the fourth embodiment.

Referring next to FIGS. 26 through 31, there will be described modified embodiments of the present invention, which use a display 23 which is different from the display 7 in connection with the manner of scrolling. The cursor and scroll control sub-routines used in the modified embodiments are illustrated in the flow charts of FIGS. 27, 29 and 31. Steps ST43, ST53 and ST63 in these sub-routines are different from the corresponding step ST33 of the sub-routine of FIG. 25 used in the first embodiment. However, steps ST42, ST52 and ST62 of FIGS. 27, 29 and 31 are similar to the corresponding step ST32 of FIG. 25.

In the second embodiment of FIGS. 26(*a*) and 26(*b*) and 27, the screen of the display 23 has five columns when the band of icons for the alphabetic letters and numerals is partially displayed at one time. If the dial 8 is rotated clockwise even after the cursor 23*a* is located at the rightmost column (corresponding to letter "E") on the screen, as indicated in FIG. 26(*a*), an affirmative decision (YES) is obtained in step ST41 of the sub-routine of FIG. 27, and the control flow goes to step ST43 in which the screen image is changed from that of FIG. 26(*a*) to that of FIG. 26(*b*). In the new screen image of FIG. 26(*b*), the icon for the letter "D" preceding the letter "E" whose icon is displayed at the rightmost column in the preceding screen image of FIG. 26(*a*) is located at the first or leftmost column, followed by the icons for the following letters "E", "F", "G" and "H". In other words, the icon for the letter "E" displayed at the rightmost or fifth column in the preceding screen image of FIG. 26(*a*) is located at the second column in the new screen image of FIG. 26(*b*). This manner of scrolling permits the operator to observe the icons for the letters "D" and "E" which appeared in the preceding screen image.

In the third embodiment of FIGS. 28(*a*) and 28(*b*) and 29, the screen of the display 23 also has five columns when the band of icons is partially displayed. If the dial 8 is rotated clockwise even after the cursor 23*a* is located at the rightmost column on the screen, as indicated in FIG. 28(*a*), an affirmative decision (YES) is obtained in step ST51 of the sub-routine of FIG. 29, and the control flow goes to step ST53 in which the screen image is changed from that of FIG. 28(*a*) to that of FIG. 28(*b*). In the new screen image of FIG. 28(*b*), the icon for the letter "E" displayed at the rightmost column in the preceding screen image of FIG. 28(*a*) is located at the first or leftmost column, followed by the icons for the following letters "F", "G", "H" and "I". This manner of scrolling permits the operator to observe the icon for the letter "E" which appeared in the preceding screen image.

In the fourth embodiment of FIGS. 30(*a*) and 30(*b*) and 31, the screen of the display 23 also has five columns when the band of icons is partially displayed. If the dial 8 is rotated clockwise even after the cursor 23*a* is located at the rightmost column on the screen, as indicated in FIG. 30(*a*), an affirmative decision (YES) is obtained in step ST61 of the sub-routine of FIG. 31, and the control flow goes to step ST63 in which the screen image is changed from that of FIG. 30(*a*) to that of FIG. 30(*b*). In the new screen image of FIG. 30(*b*), the icon for the letter "B" displayed at the second column in the preceding screen image of FIG. 30(*a*) is located at the first or leftmost column, followed by the icons for the following letters "C", "D", "E" and "F". Thus, the icons in the new screen image of FIG. 30(*b*) are shifted one column to the left with respect to the icons in the preceding screen image of FIG. 30(*a*). This manner of scrolling permits the operator to observe the icons for the four letters "B" through "E" which appeared in the preceding screen image.

While the present invention has been described in its presently preferred embodiments for illustrative purpose only, it is to be understood that the invention may be otherwise embodied.

Figure 32:
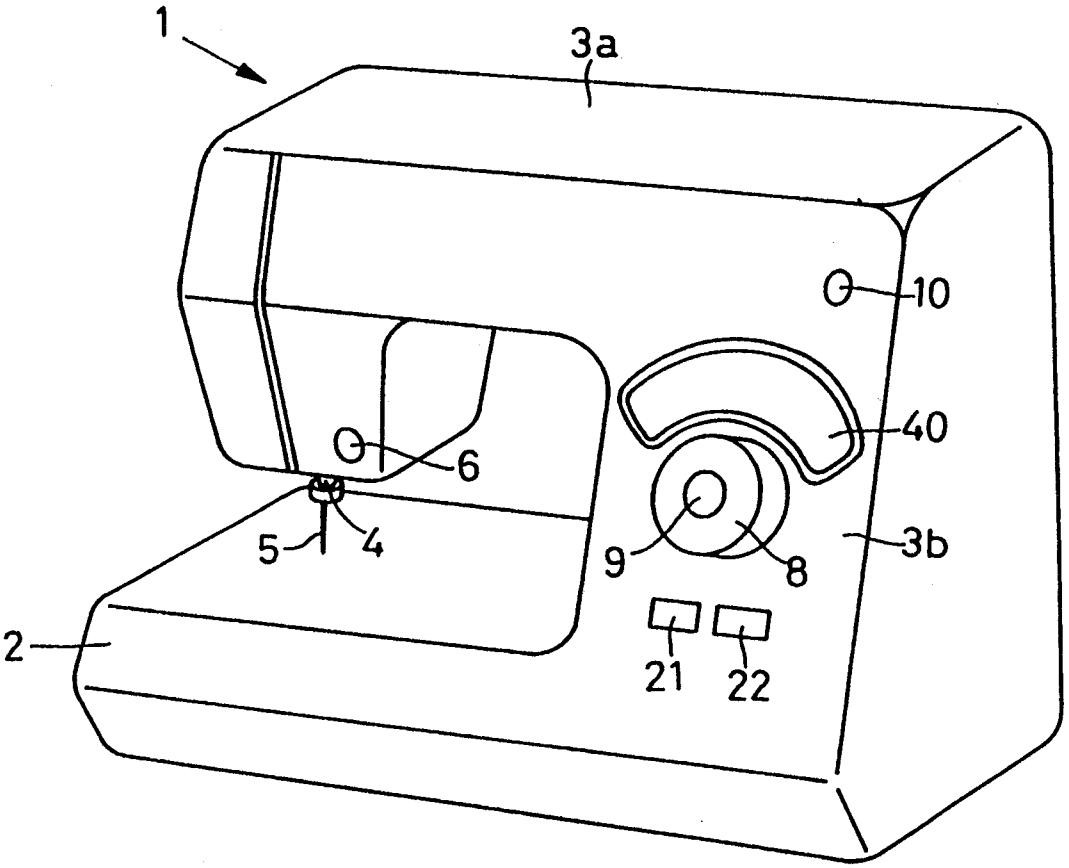
FIG. 32 is a view of a modified screen of the sewing machine.

In the illustrated embodiments, the screen of the display 7, 23 extends straight in the horizontal direction, so that the cursor 7*a*, 23*a* is moved to the right and left when the dial 8 is rotated clockwise and counterclockwise, respectively. According to this arrangement, the rotating directions of the dial 8 more or less match the moving directions of the cursor on the screen on the display 7, 23, i.e., the scrolling directions of each band of icons. However, the screen may be modified so as to extend substantially along an arc whose radius lies on the center of the dial 8 (center of the ENTER key 9, as shown in FIG. 32). This modification increases the degree of matching between the rotating directions of the dial 8 and the scrolling directions of the screen image.

While the four different manners of scrolling of the display 7, 23 are employed in the first, second, third and fourth embodiments, respectively, it is possible to modify the control device 30 so that the four different subroutines of FIGS. 25, 27, 29 and 31 are available and selectively used as needed. This selection may be made on the display 7, 23, in a manner similar to the manners in which the standard stitch patterns and special patterns are selected by means of the corresponding icons displayed on the screen image in the illustrated embodiments described above.

While the band of icons identifying the different types of patterns (standard stitch patterns, letters, ornamental patterns, etc.) takes the form of characters describing the types of patterns, as indicated in FIG. 6, other forms of icons such as symbol marks or graphic illustrations may be used as the icons for identifying the types of patterns. In the present disclosure, any forms of visible representations displayed for selection of selectable items on the screen of the display 7, 23 are referred to as icons, which should be distinguished from the corresponding patterns that are created by stitches actually formed on the work fabric.

It is to be understood that the present invention may be embodied with various other changes, modifications and improvements, which may occur to those skilled in the art, without departing from the spirit and scope of the invention defined in the following claims.

What is claimed is:

1. A sewing machine for performing a sewing operation including forming a selected one of a plurality of different patterns, each pattern being created by a plurality of stitches formed on a work fabric, the sewing machine comprising:

a display device having a screen displaying a number of selectable items of a library of selectable items, the library of selectable items including at least one band of selectable items identifying said plurality of different patterns, said library including a high-order band of selectable items and a plurality of low-order bands of selectable items, each low-order band of selectable items associated with a corresponding one of the selectable items of said high-order band, at least one of said high-order band and said low-order bands comprising said at least one band of selectable items;

a display controller including an operator-controlled rotatable display control dial, the display controller specifying one of said selectable items displayed on said screen in response to a rotary movement of said display control dial, the displayed selectable items formed by one of said high-order band and said low-order bands, said display controller scrolling said library of selectable items and changing a current image on said screen to a new current image on said screen when said display control dial is rotated to specify one of said selectable items not included in said current image on said screen;

a selector including an operator-controlled selecting member, said selector selecting the specified one of said selectable items based on an operation of said selecting member, wherein when the selected item is one of said selectable items of said high-order band, said display device displays the corresponding one of said low-order bands, said display controller being capable of specifying one of said selectable items of said corresponding low-order band based on a rotary movement of said display control dial and said selector being capable of selecting the specified one of said selectable items of said corresponding low-order band based on an operation of said selecting member, said selector selecting at least one selectable item from said at least one band of selectable items; and a stitch forming mechanism forming the stitches of the pattern corresponding to the selected item.

2. The sewing machine of claim 1, wherein when said display controller scrolls said library to display said new image on said screen, said next selectable item being located at the other end of said new image.

3. The sewing machine of claim 1, wherein when said display controller scrolls said library to display said new image on said screen, said new image includes said next selectable item, a preceding selectable item and a succeeding selectable item, said preceding selectable item immediately preceding the next selectable item and the succeeding selectable item immediately succeeding the next selectable item.

4. The sewing machine of claim 1, wherein said display control dial includes a ratchet device maintaining said display control dial at one of a plurality of angular positions, said display controller specifying said selectable item when said display control dial is maintained at one of said angular positions.

5. The sewing machine of claim 1, wherein said display controller further includes an operator-controlled clearing member, and a processor controlling said display device, the display device displaying at least one selectable item of said high-order band when a low-order band is displayed on said screen and said operator-controlled clearing member is operated.

6. The sewing machine of claim 1, wherein said display controller further includes dimension display means for displaying at least one value relating to a dimension of one of said different patterns selected by said selector, and an operator-controlled dimension changing member changing said at least one value displayed on said screen, wherein said dimension of said pattern changes when said one value changes.

7. The sewing machine of claim 1, wherein said selector selects said specified one of said selectable items when said operator-controlled selecting member is operated while one of said displayed selectable items is in a special mode, the special mode being different from a mode of the other displayed selectable items.

8. The sewing machine of claim 1, wherein said at least one band of icons includes at least two bands of icons, the two bands selected from the following: a first band of icons identifying standard stitch patterns, wherein the stitches sew a plurality of fabric cloths together; a second band of icons identifying ornamental patterns defined by the stitches formed on said work fabric; a third band of icons identifying letters defined by the stitches formed on said work fabric; a fourth band of icons identifying numerals defined by the stitches formed on said work fabric; and a fifth band of icons identifying symbols defined by the stitches formed on said work fabric.

9. The sewing machine of claim 1, wherein said display controller further includes a memory, the memory storing data representative of said at least one band of icons.

10. The sewing machine of claim 8, wherein said at least one band of icons includes said first band of icons, and said display controller controls said display device to display one of said icons of said first band selected by said selector and at least one value, each displayed value relating to a dimension of said standard stitch pattern identified by the displayed icon.

11. A sewing machine for performing a sewing operation including forming a selected one of a plurality of different patterns, each pattern being created by a plurality of stitches formed on a work fabric, the sewing machine comprising:

a display device having a screen, the screen displaying a number of selectable items of a library of selectable items, the library of selectable items including at least one band of selectable items identifying said plurality of different patterns, said display device comprising a cursor movable on said screen to designate each of the selectable items displayed on said screen;

a display controller including an operator-controlled rotatable display control dial, said display controller moving said cursor on said screen based on a rotary movement of said display control dial, the display controller specifying one of said selectable items designated by said cursor, said display controller scrolling said library of selectable items and changing a current image on said screen to a new current image on said screen when said display control dial is rotated to move said cursor to one of said selectable items not included in said current image on said screen, wherein when said display control dial is rotated to move said cursor to a next selectable item not included in said current image and adjacent to a selectable item displayed at one end of said current image on said screen, said display controller scrolls the library to display the new image on said screen, the new image including said next selectable item and at least one other selectable item adjacent to said next selectable item and not included in said current image;

a selector including an operator controlled selecting member, the selector selecting the specified one of said selectable items based on an operation of said selecting member, said selector selecting at least one selectable item from said at least one band of selectable items; and a stitch forming mechanism forming the stitches of the pattern corresponding to the selected item.

12. The sewing machine of claim 11, wherein when said display controller scrolls said library of selectable items, said new image includes said next selectable item, a plurality of immediately preceding selectable items and a plurality of immediately succeeding selectable items.

13. The sewing machine of claim 11, wherein when said display controller scrolls the library from said current image to said new image, said display controller moves said cursor from a position of one end of the current image to a position of the next selectable item in the new image.

14. A sewing machine for performing a sewing operation including forming a selected one of a plurality of different patterns, each pattern being created by a plurality of stitches formed on a work fabric, the sewing machine comprising:

a display device having a screen, the screen displaying a number of selectable items of a library of selectable items, the library of selectable items including at least one band of selectable items identifying said plurality of different patterns;

a display controller including an operator-controlled rotatable display control dial, the display controller specifying one of said selectable items based on a rotary movement of said display control dial, said display controller scrolling said library of selectable items and changing a current image on said screen to a new current image on said screen when said display control dial is rotated to specify one of said selectable items not included in said current image on said screen;

a selector including an operator-controlled selecting member, the selector successively selecting, based on successive operations of said selecting member, a plurality of displayed and specified selectable items from said at least one band of selectable items identifying said different patterns; and a stitch forming mechanism forming the stitches of the pattern corresponding to each of the plurality of successively selected items, wherein said display controller controls said display device to display said plurality of successively selected items such that one of the plurality of successively selected items is displayed in a special mode different from a mode of displaying of the at least one other successively selected item, the special mode indicating that the pattern identified by said special mode is being formed on said work fabric by said stitch forming mechanism.

15. The sewing machine of claim 14, wherein each band of icons represents a plurality of characters.

16. The sewing machine of claim 14, wherein said screen includes two regions, said at least one band of icons being displayed on one of said two regions and at least one of said plurality of successively selected icons being displayed on the other of said two regions.

17. The sewing machine of claim 14, wherein said display controller controls said display device to remove one of said displayed successively selected icons from said screen after the corresponding pattern has been created on said work fabric.

18. The sewing machine of claim 17, wherein said display controller controls said display device and removes said displayed successively selected icon by replacing said displayed successively selected icon with a succeeding displayed successively selected icon.

19. A sewing machine for performing a sewing operation including forming a selected one of a plurality of different patterns, each pattern being created by a plurality of stitches formed on a work fabric, the sewing machine comprising:

a display device having a screen, the screen displaying a number of selectable items of a library of selectable items, the library of selectable items including at least one band of items identifying said plurality of different patterns, said display device comprising a cursor movable on said screen to designate each of the selectable items displayed on said screen;

a display controller including an operator-controlled rotatable display control dial, said display controller moving said cursor on said screen based on a rotary movement of said display control dial, the display controller specifying one of said selectable items designated by said cursor, said display controller scrolling said library of selectable items and changing a current image on said screen to a new current image on said screen when said display control dial is rotated to move said cursor to one of said selectable items not included in said current image on said screen, wherein said screen is disposed adjacent to said display control dial and said display controller moves said cursor on the screen in a direction substantially the same as a direction of said rotary movement of the control dial;

a selector including an operator-controlled selecting member, the selector selecting the specified one of said selectable items based on an operation of said selecting member, said selector selecting at least one selectable item from said at least one band of selectable items; and a stitch forming mechanism forming the stitches of the pattern corresponding to the selected item.

20. The sewing machine of claim 19, wherein said screen of said display device extends substantially along an arc, a radius of the arc lying on a center of said display control dial, and said display controller controls said display device to move said cursor on the screen in a same rotary direction as said direction of rotary movement of said display control dial.

21. The sewing machine of claim 19, wherein said screen of said display device extends straight and a middle portion of the straight screen is closest to said display control dial, said display controller moving said cursor on said straight screen in said direction substantially the same as the direction of said rotary movement of said display control dial.

* * * * *